United States Patent [19]

McDonough et al.

[11] 3,990,210

[45] Nov. 9, 1976

[54] PACKAGING AND BLANK HANDLING SYSTEMS

[75] Inventors: David R. McDonough; Henry W. McDonough, both of Dundee, Ill.

[73] Assignee: McDonough Manufacturing Company, Elgin, Ill.

[22] Filed: Aug. 23, 1974

[21] Appl. No.: 499,865

Related U.S. Application Data

[62] Division of Ser. No. 360,587, May 15, 1973, Pat. No. 3,844,088.

[52] U.S. Cl. ..... 53/32; 53/191

[51] Int. Cl.[2] ..... B65B 11/12

[58] Field of Search ..... 53/3, 186, 191, 207, 53/389, 32, 230, 180, 180 M, 182, 182 M; 93/49 R, 49 M, 53 R, 53 M, 53 BF, 53 SD; 271/100, 101, 12, 35, 131; 198/172, 174

[56] References Cited

UNITED STATES PATENTS

| | | | |
|---|---|---|---|
| 1,151,792 | 8/1915 | Jaeger | 271/131 X |
| 2,462,254 | 2/1949 | Campbell | 53/182 X |
| 2,645,984 | 7/1953 | Lindstedt | 93/49 R |
| 3,014,321 | 12/1961 | Lesch | 53/157 |
| 3,303,630 | 2/1967 | Harm | 53/182 X |
| 3,323,275 | 6/1967 | Kingsbury | 53/203 X |
| 3,390,875 | 7/1968 | Beert | 271/101 |
| 3,555,776 | 1/1971 | Nigrelli | 53/207 X |
| 3,583,888 | 6/1971 | Shanklin | 53/182 |
| 3,599,970 | 8/1971 | Smithe | 271/101 X |
| 3,656,417 | 4/1972 | Scully | 93/53 R |
| 3,812,641 | 5/1974 | Remiss | 53/14 |

FOREIGN PATENTS OR APPLICATIONS

| | | | |
|---|---|---|---|
| 844,265 | 8/1960 | United Kingdom | 198/174 |

*Primary Examiner*—Othell M. Simpson
*Assistant Examiner*—John Sipos
*Attorney, Agent, or Firm*—Charles B. Cannon

[57] ABSTRACT

Flat blanks are fed from a stack by bending back a flap to form an inside corner, engaging the corner with a puller bar and pulling the blank from the stack and along a path past plows which bend the blank to form it about a mandrel while a product to be packaged is moved along inside the mandrel in synchronism with the blank movement. Pusher element retraction means are also disclosed as are rotation means for rotating partially completed cartons to orient extended end tabs and flaps with stationary plows for effecting end closure of the cartons thus formed.

26 Claims, 34 Drawing Figures

131
84
76
15
94
216
74
120
214
220
236
136
210
106
234
72
218
232
124
238
226
52
230
209
228
222
52
130
128
126
15
136

120
224
94
216
230
224a
234
214
236
210
238
136
52
238
120
130
226
228
209
128

120
94
234
224
214
216
136
230
210
52
130
238
209
120
128

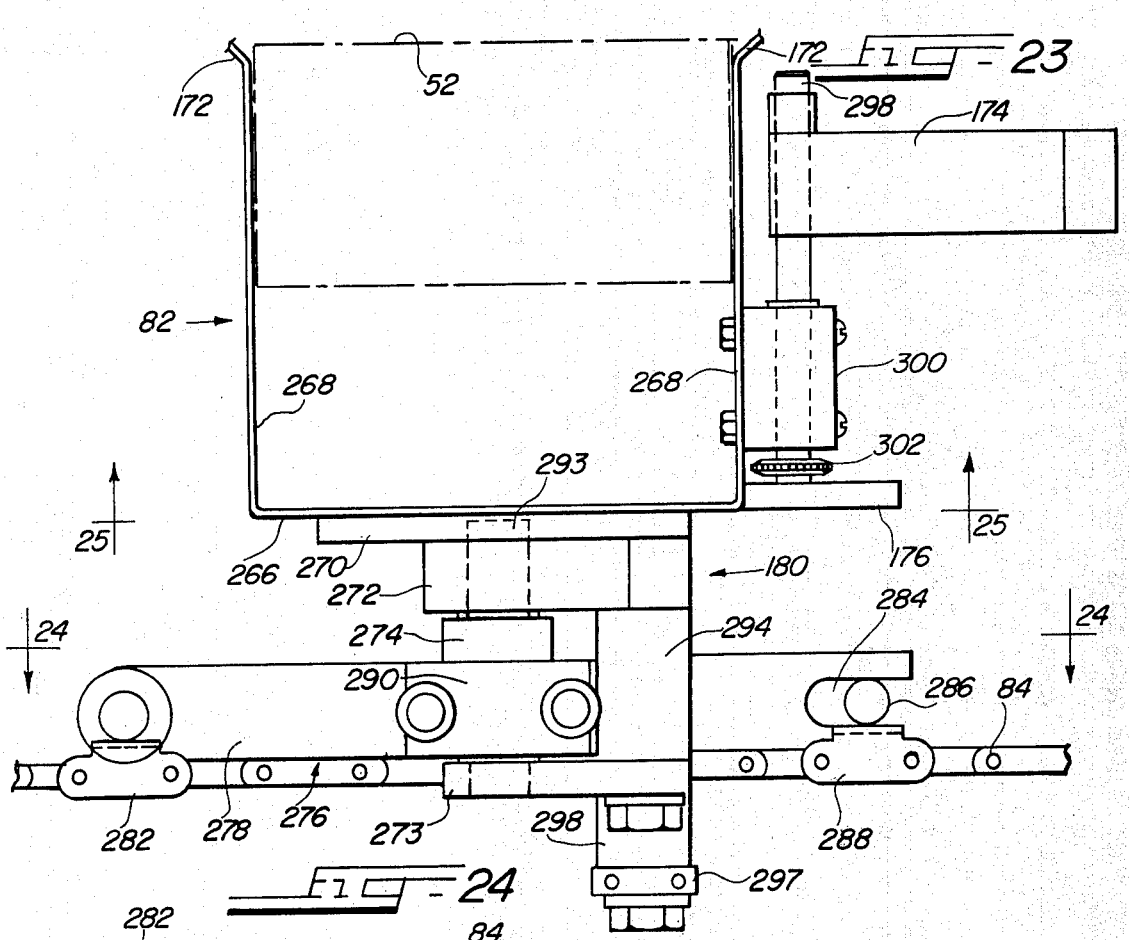
FIG. 23
FIG. 24
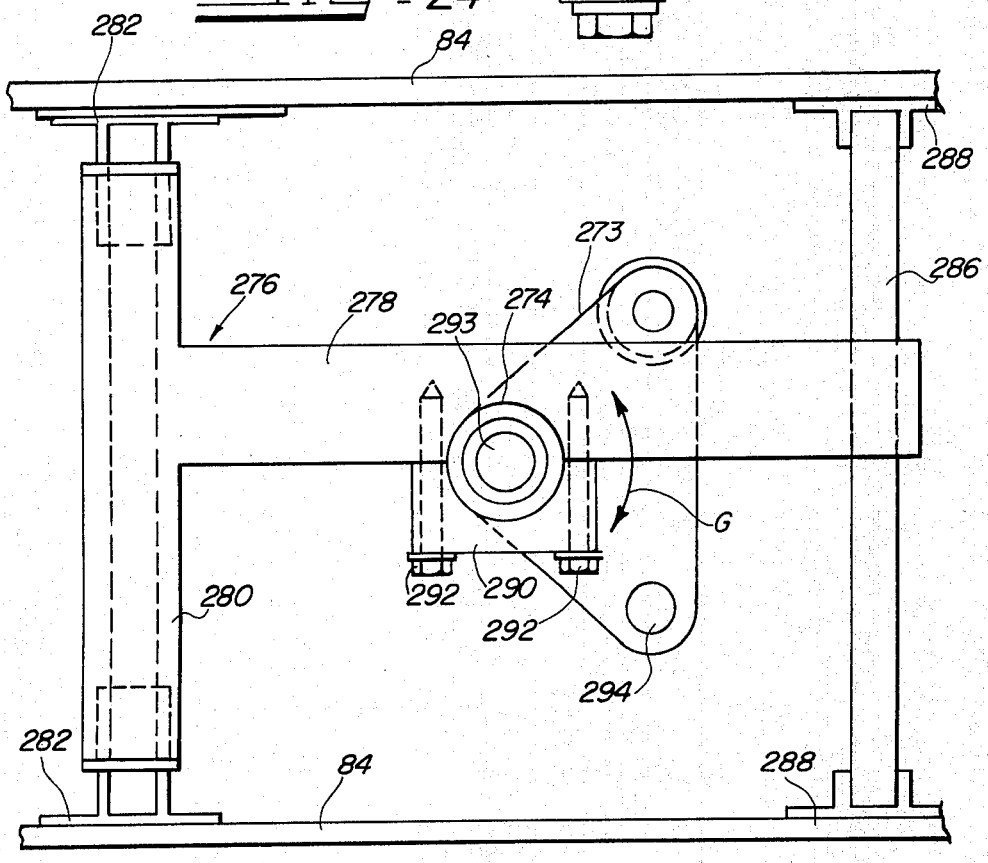

362
364
350
322
396
394
366
352
367
368
360
358
412

PACKAGING AND BLANK HANDLING SYSTEMS

This application is a division of applicant's co-pending application, Ser. No. 360,587, filed May 15, 1973 and entitled "Packaging and Blank Handling Systems" now U.S. Pat. No. 3,844,088, issued Oct. 29, 1974.

This invention relates to the packaging of materials and more particularly it concerns novel methods and apparatus for forming cartons around products to be packaged therein.

In the packaging industry, cartons are formed from stiff paperboard blanks which are precut to a given shape and which are slit and scored along selected lines to form side panels and end flaps and tabs. These blanks are conveyed individually along a given path, different ones of the tabs, flaps and panels engage stationary plow elements and the like which bend over the panels and tabs in sequence to accomplish the formation of a completed container. Selected tabs and flaps may be given an application of adhesive just before they are folded over in order to seal the container closed. In some instances the materials to be packaged in the carton is supplied to the carton blank and the blank is formed around the material. The carton blanks themselves are usually stacked in a hopper at one end of the blank forming machinery; and means are provided to peel off the carton blanks one at a time from the stack and to transfer the blanks to the conveyor.

Certain problems are involved in carrying out the above described operations. For example, care must be taken to avoid mutilation of the blanks in the separation of individual blanks from the supply hopper and during conveying and bending of the blanks to form a finished carton. Also, the blanks must be conveyed positively in proper position and orientation in order to permit the flap, tab and panel bending plow elements to function properly. In the case of containers which are formed about the material to be packaged, it is necessary to maintain synchronism between the material and the blank.

Another problem encountered in the formation of cartons around materials to be packaged is that of providing interior or mandrel type support, so that the bending plow elements can produce a positive and well defined carton shape. This problem is made especially difficult where the carton is to be formed about the material to be packaged and the material itself does not have a solid, well defined shape. In such case some rigid forming mandrel must be provided between the material being packaged and the carton blank.

The present invention, in its various aspects, serves to overcome the above described problems and enables the formation of cartons and packaging of materials in the cartons in a rapid and reliable manner.

According to one aspect of the invention carton blanks are conveyed in a novel manner without slippage or misalignment and without damage, while the blank passes along plow elements which bend into various panels to the configuration of a finished carton. This conveying is carried out according to the present invention, by bending one end flap of the carton blank back against an adjacent panel and inserting a thin elongated puller bar into the inside corner thus formed across the blank. As the puller bar moves along it drags the blank along with it while the blank remains positively positioned and oriented with respect to the puller bar.

According to another aspect of the invention novel arrangements are provided for separately withdrawing individual carton blanks from a stack in a supply hopper. This withdrawing is carried out by arranging the carton blanks such that they lie against a support plate having an upper edge aligned with an end flap fold line of the carton blanks with the end flaps of the blanks extending above the upper edge of the support plate. A suction element is moved into engagement with the exposed end flap face of the carton blank lying immediately adjacent the support plate, and then the suction element is pulled back to partially bend the flap across the support plate. This produces an opening between the flap and corresponding flap of the next adjacent blank. A pusher element is caused to enter into this opening and to continue moving down past the edge of the support plate and along the side thereof opposite from the carton blanks. This completed the bending of the flap back over the edge of the plate. The carton blank whose end flap is thus bent back is removed from the stack by causing a puller bar as described above, to move along the support plate to engage the inside corner formed in the carton blank by the flap bending operation.

According to a further aspect of the present invention carton blanks are accurately formed about products which are not necessarily firm or of well defined shape. This formation of carton blanks is achieved by causing the product to be packaged to be pushed along an open top trough whose external cross-section corresponds to that of the finished carton blank and whose internal cross-section accomodates movement therealong of the product to be packaged. The product is pushed along the trough in synchronism with the movement of carton blanks through the trough; and during this movement the carton blank is formed about the trough exterior.

Another aspect of the invention involved novel product pusher means comprising a support arm pivotally connected to an endless loop, such as a chain, at a first location and a control link pivotally connected between second locations on the arm and the loop. As the portion of the loop carrying the arm passes around a sprocket or pulley at the end of its product pushing movement, the curve assumed by the loop between the first and second locations draws them closer together and the control link pushes on the arm so that it swings with respect to the loop. This served to withdraw the pusher element from within the carton before the arm is carried around the pulley or sprocket, thereby avoiding interference between the pusher element and the upper end flaps of the carton.

In a still further aspect, the present invention involves the provision of novel end flap and tab closure means including carton carriers along a conveyer and which engage and rotate partially finished cartons to bring their various end flaps and tabs into proper position to be intercepted and closed by stationary plow elements along the conveying path.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other structures and techniques for carrying out the purposes of this invention. It is important, therefore, that this disclosure be regarded as including such equivalent constructions and techniques as do not depart from the spirit and scope of the invention.

Several embodiments of the invention have been chosen for purposes of illustration and description, and are shown in the accompanying drawings forming a part of the specification, wherein.

Figure 1:
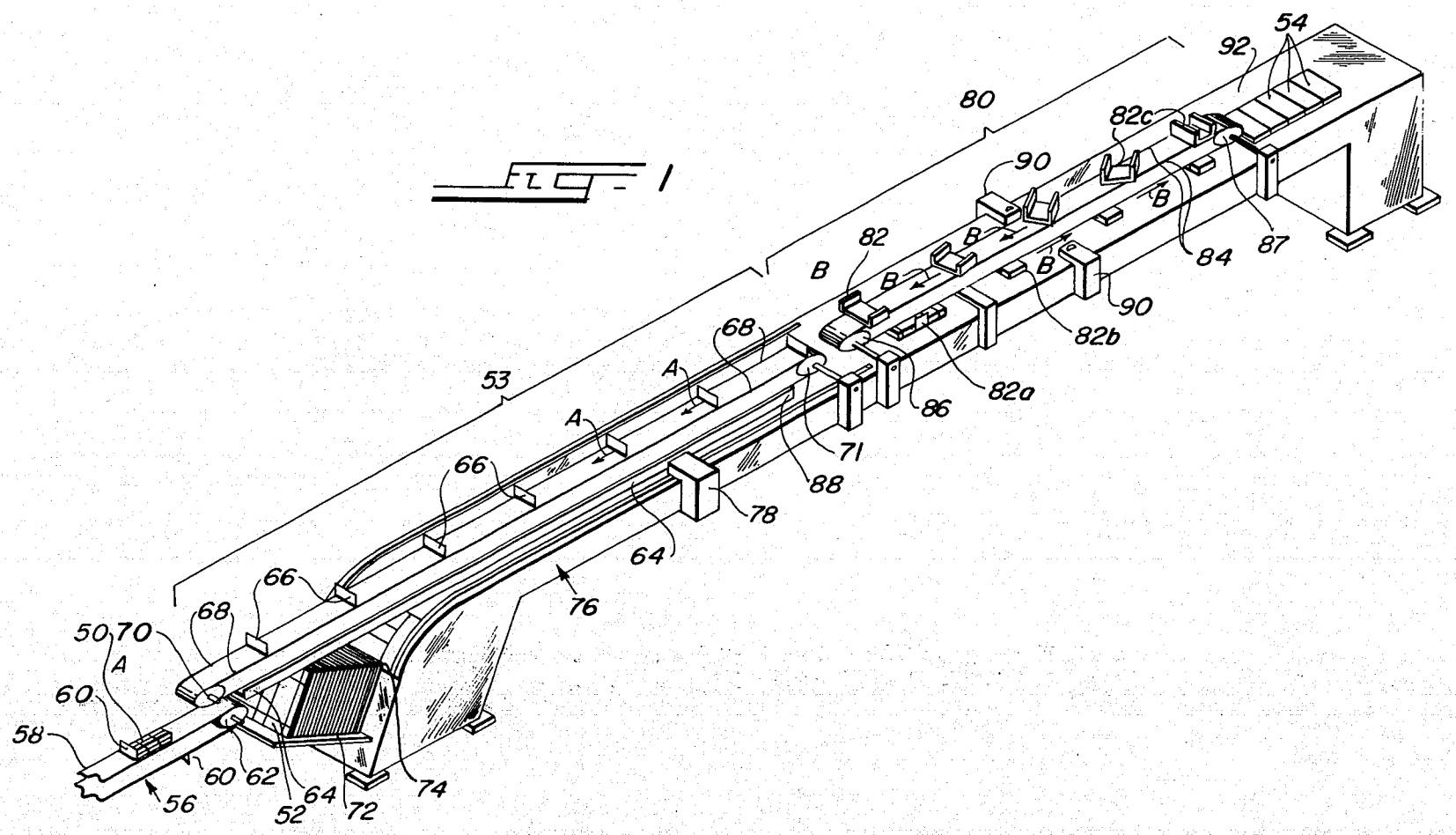
FIG. 1 is an overall perspective view of a packaging machine in which the present invention is embodied.
Figure 20A:
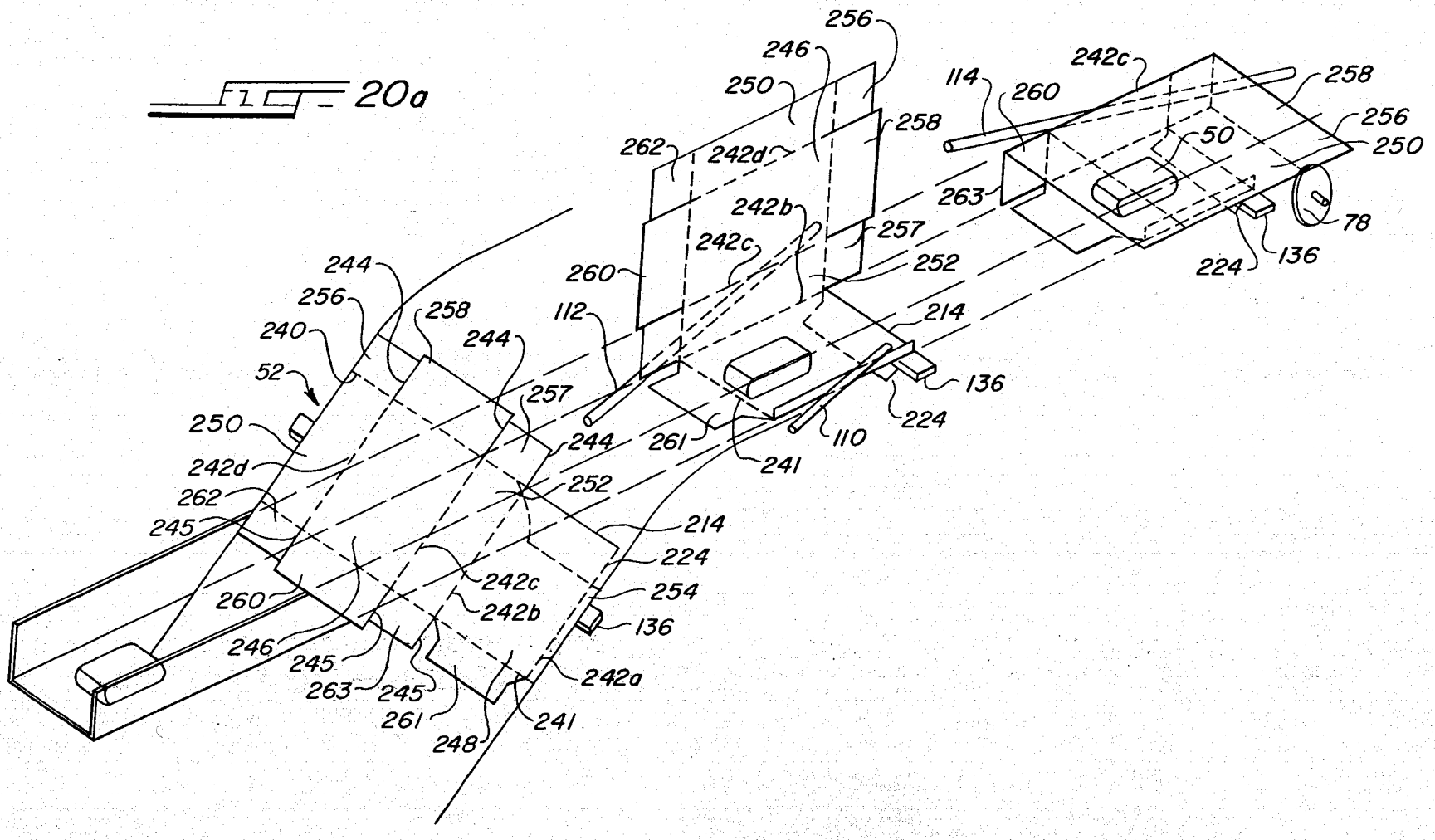
Figure 20B:
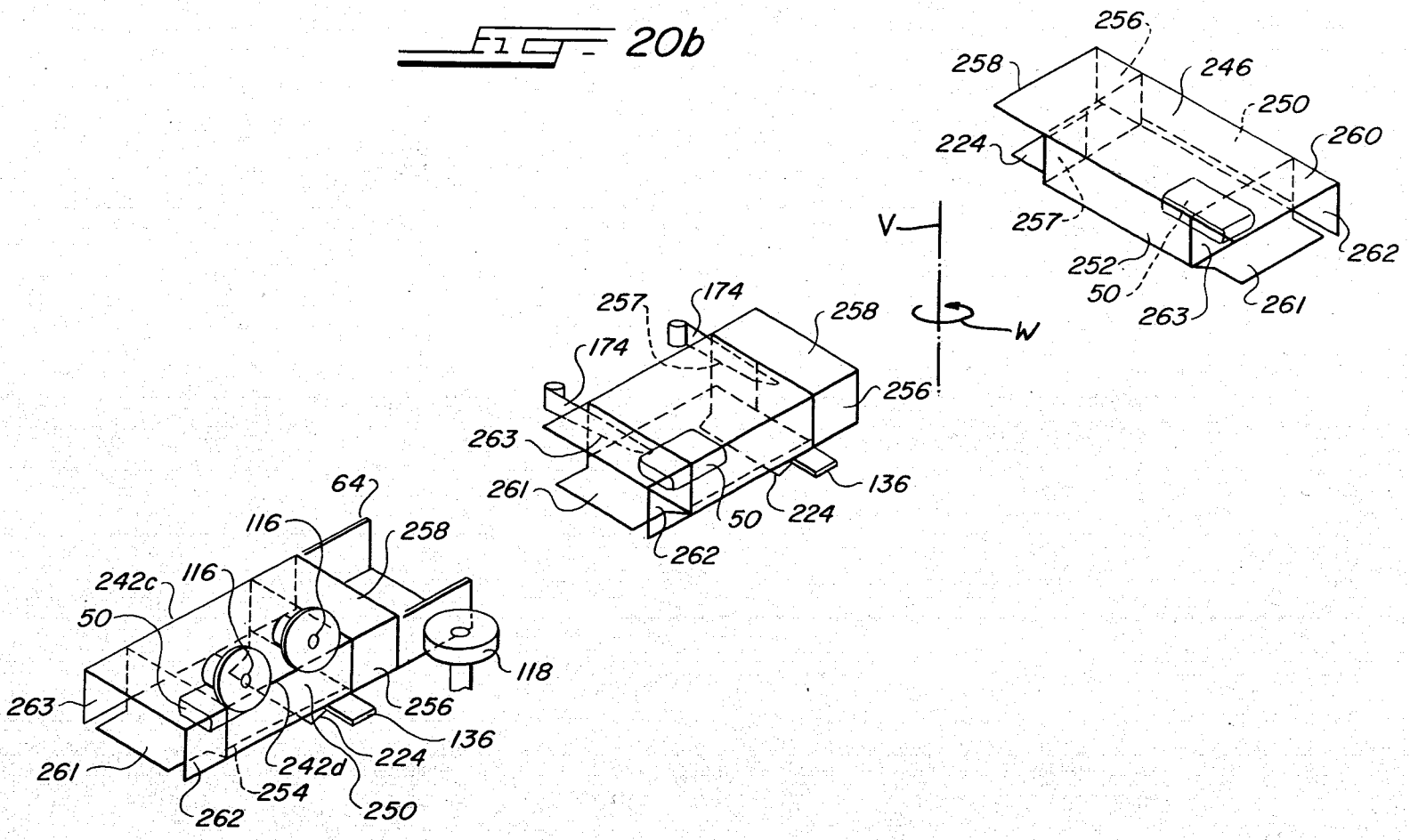
Figure 20C:
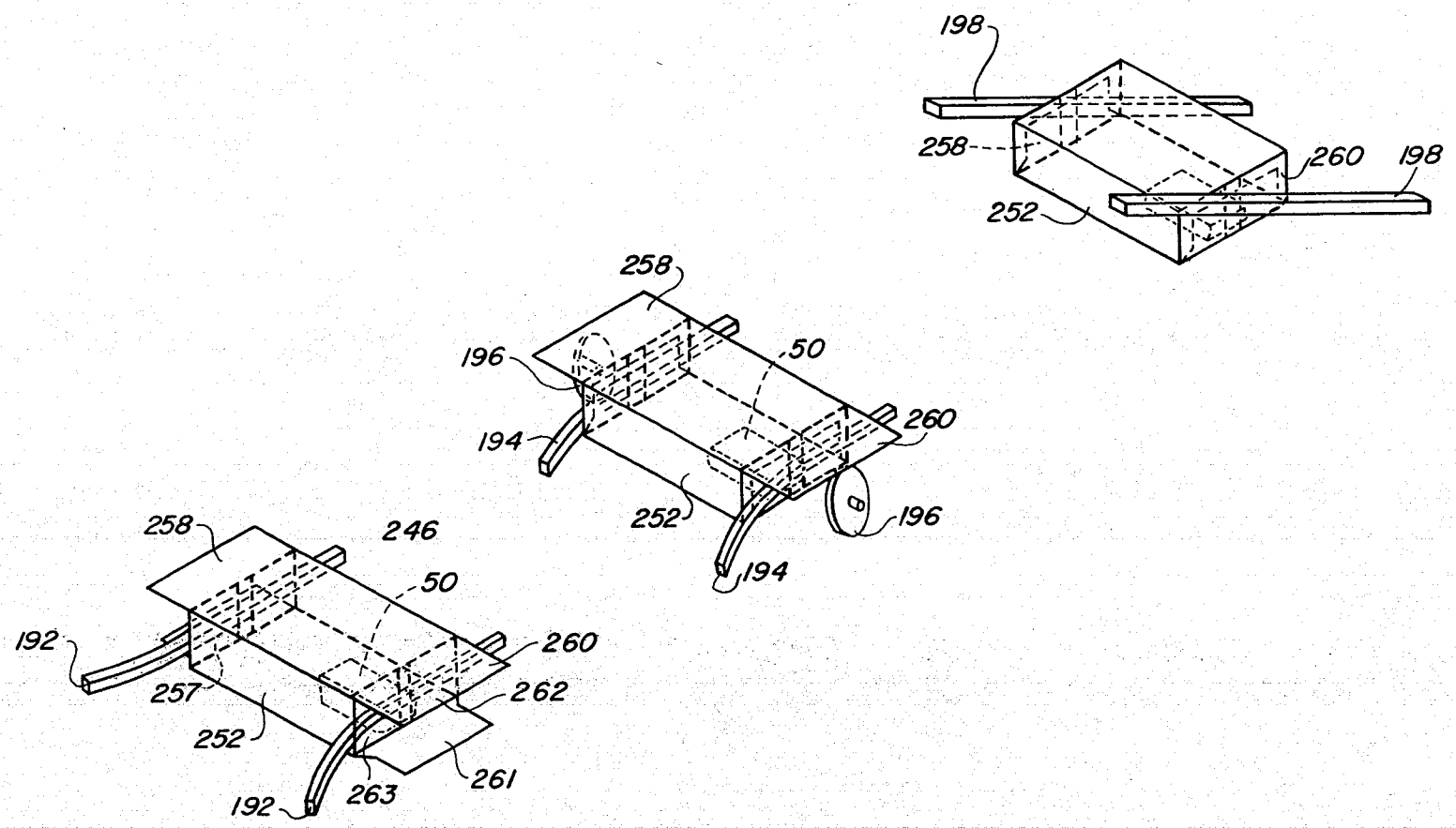
Figures 21, 22:
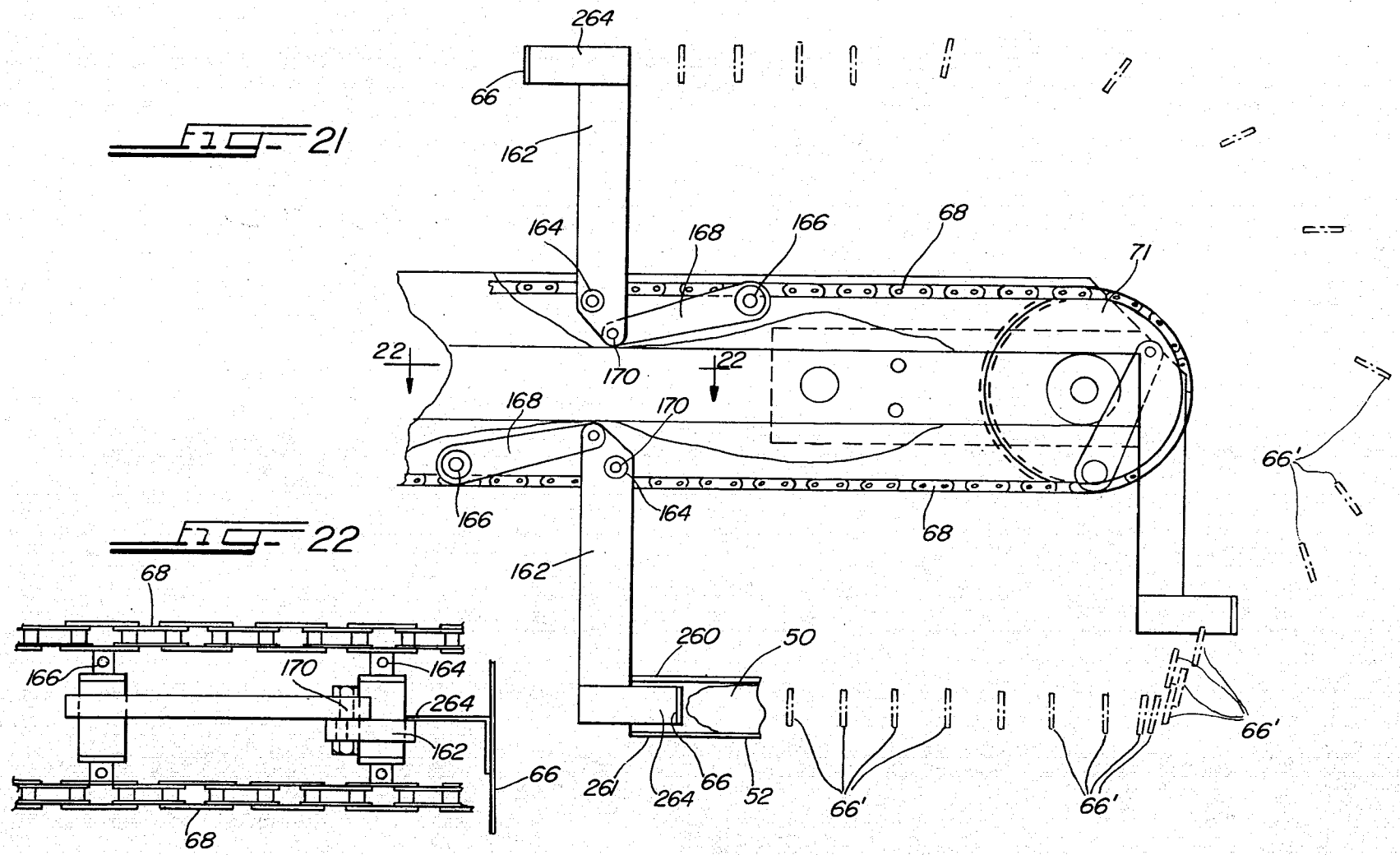
Figure 25:
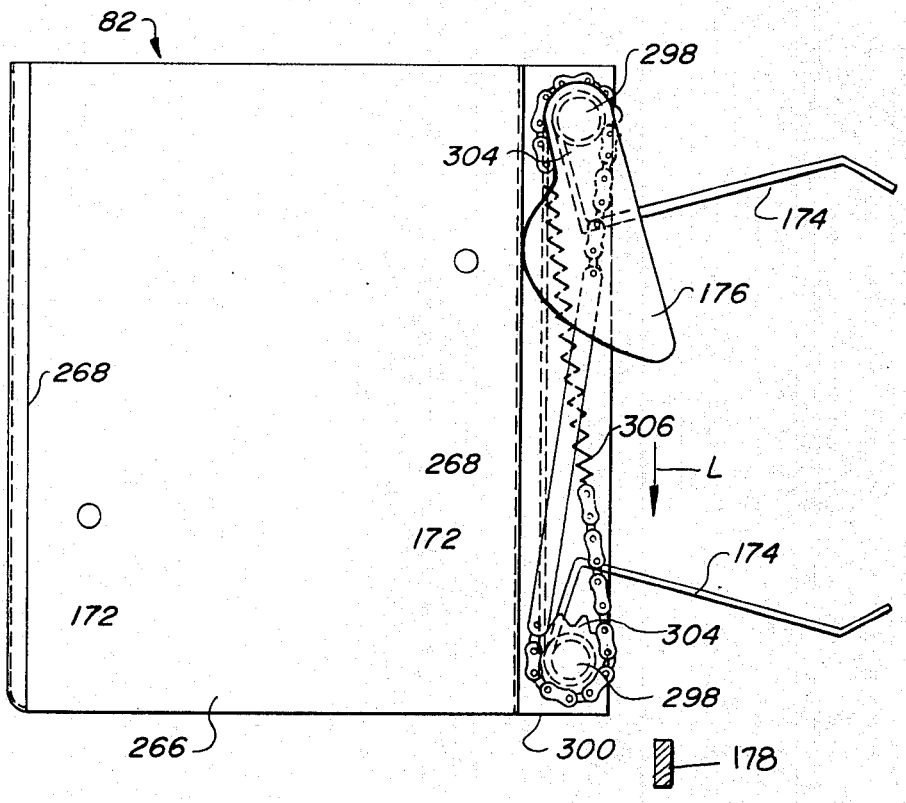
Figure 26:
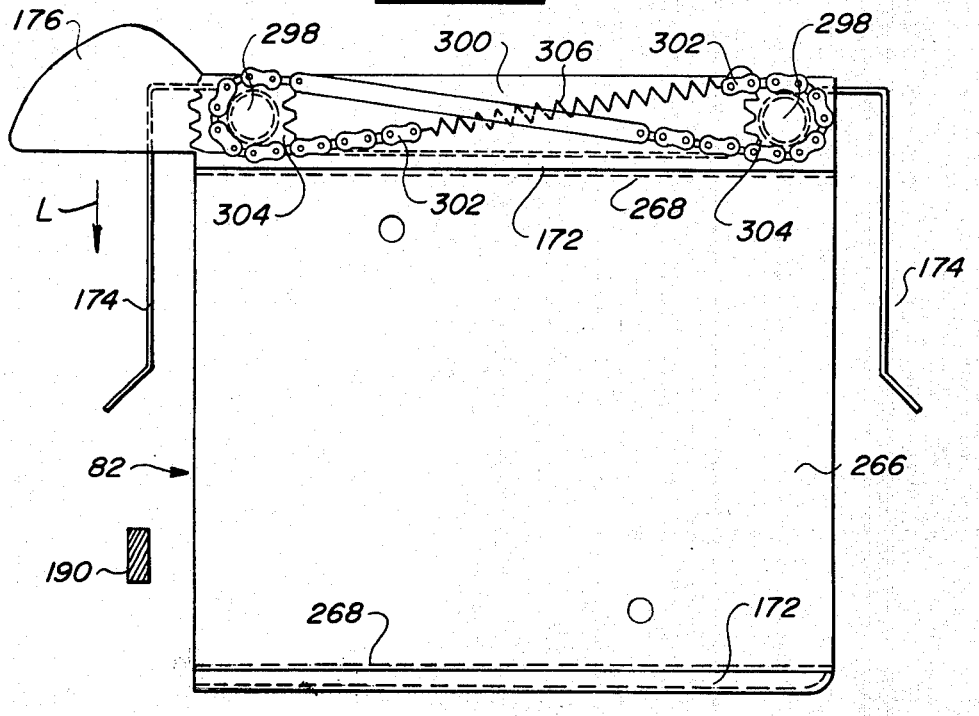
Figure 27:
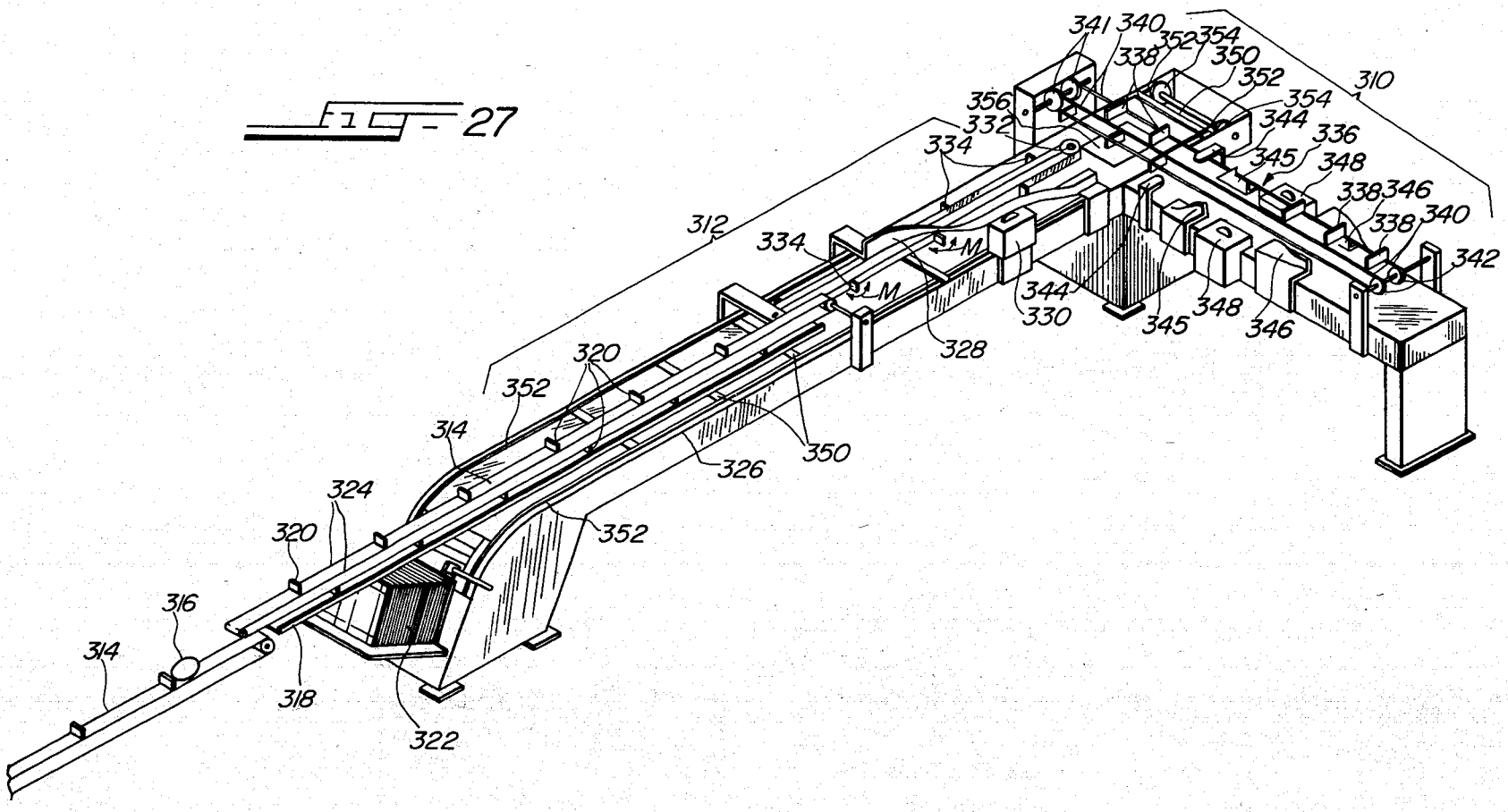
Figure 28:
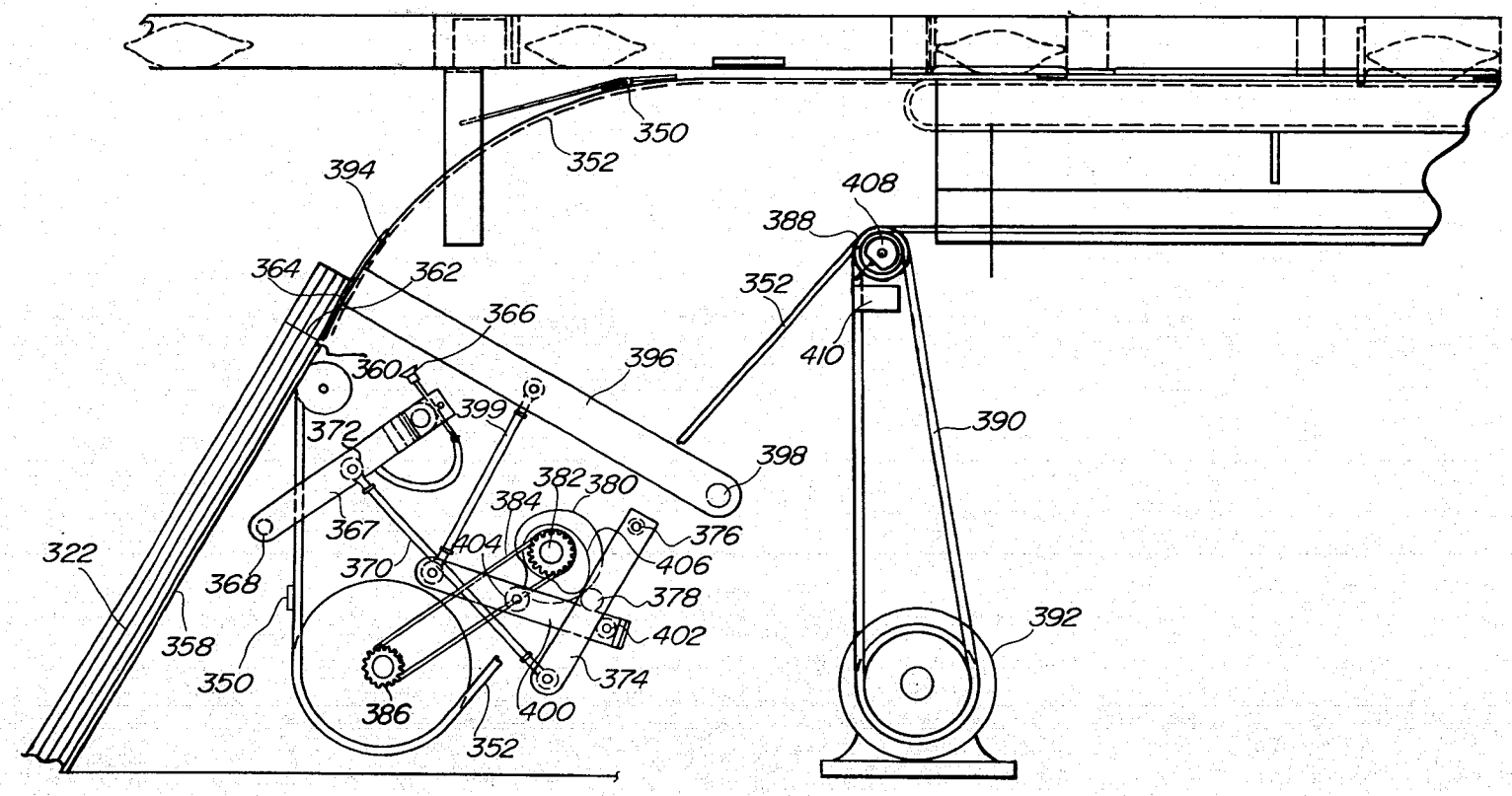

FIGS. 20*a*, 20*b* and 20*c* are schematic representations illustrating the action of the packaging machine of FIG. 1 in forming carton blanks into product containing cartons;

FIG. 21 is an enlarged fragmentary view illustrating the construction and operation of a product pusher and its mounting arrangement used in the embodiment of FIG. 1;

FIG. 22 is a view taken along line 22—22 of FIG. 21;

FIG. 23 is an enlarged side elevational view of a carton carrier and mounting arrangement therefore employed in the embodiment of FIG. 1;

FIG. 24 is a view taken along line 24—24 of FIG. 23;

FIG. 25 is a view taken along line 25—25 of FIG. 23;

FIG. 26 is a view similar to FIG. 25 showing the carton carrier at a different stage of operation;

FIG. 27 is an overall perspective view showing another embodiment of the present invention;

FIG. 28 is an enlarged side elevational view, partially cut away, showing a modified blank feed mechanism used in the embodiment of FIG. 27; and FIGS. 29–32 are fragmentary views showing operating elements of the feed mechanism of FIG. 28 at different successive stages of operation.

The packaging machine shown in FIG. 1 receives product bundles 50 and flat carton blanks 52 at one end of a main carton forming portion 53; and forms the blanks around the product bundles and dispenses fully packaged cartons 54 at the opposite or output end of the machine.

The product bundles 50 may comprise any substance of predetermined size or weight. Where the substance is pulverulent or semi-fluid it may be pre-bagged in measured amounts. In many cases the product bundles 50 are relatively formless and they are often not capable of retaining any particular form. The packaging provided by the present invention serves to protect these product bundles within packages of definite and uniform size and configuration.

The product bundles 50 are supplied serially in spaced apart relationship along a product feed conveyor 56. This feed conveyor comprises a belt 58 along which spacer elements 60 are distributed. The product bundles 50 are supplied between the spacer elements 60 by any suitable product supply means not shown; and the product bundles are carried along the belt 58 toward the main carton forming portion 53 of the packaging machine.

The product feed belt 58 passes over a front pulley 62 located near the receiving end of a stationary trough 64. The trough 64, which extends lengthwise of the packaging machine, is of flat, channel-shaped cross section. The outer cross section of the trough corresponds to the cross section of cartons to be formed and it serves as a forming mandrel around which the carton blanks 52 are bent during the initial carton forming steps. The interior of the trough 64 is shaped to accomodate the product bundles 50 and to guide them along the main carton forming portion 53 as the carton blanks 52 are formed around them.

The product bundles 50 are moved along the trough 64 in properly spaced apart relationship and at a predetermined rate by means of product pusher elements 66. These pusher elements are mounted at spaced apart intervals between a pair of endless pusher element chains 68 which extend lengthwise of the machine and form an endless loop between forward and rearward pusher element sprockets 71 and 70. Drive means (not shown in FIG. 1), which will be described more fully hereinafter, serve to turn the sprockets 70 and 71 at a predetermined rate thereby to move the pusher elements 66 and the product bundles 50 along the trough 64 and in synchronism with the movements of the carton blanks 52. The direction of movement of the pusher elements 66 during operation of the machine is indicated by the arrows A in FIG. 1.

The carton blanks 52, which are precut to form end tabs and flaps, and which are prescored along bend lines separating adjacent panels tabs and flaps, are stacked in flattened condition in a carton blank supply hopper 72 at the receiving end of the machine. These blanks lie against the forward end of a carton blank feed mechanism 74 at the receiving end of the machine. A carton blank conveyor 76 is operated in conjunction with the carton blank feed mechanism 74 to withdraw carton blanks singly from the forward end of the stack and to deliver them along the machine under the stationary trough 64 in proper orientation and in synchronism with the product bundles 50 being pushed along in the trough. During the movement of the carton blanks 52, they engage various plow elements (not shown) which cause the different panels of the blank to bend about score lines which are aligned with the corners and edges of the trough 64 so that the blank becomes bent about and actually encircles the trough while a product bundle 50 is maintained by one of the pusher elements 66 in the trough but within the blank 52 as well.

During operation of the above described main carton forming portion 53 of the packaging machine, the side panels of a carton are formed about the trough 64 while the end flaps and tabs of the carton blank remain open and extended. The carton blank at this point is essentially of tubular configuration, but is open at both ends. The side panel formation is completed as the carton moves past a side panel adhesive applicator 78 which applied an adhesive to a side panel of the carton. This side panel is then bent down and pressed against a corresponding bent up panel attachment tab along the opposite edge of the carton blank.

The cartons as thus far formed pass from the main carton forming portion 53 of the machine to an end closure mechanism 80 near the output end of the machine. The end closure mechanism 80 includes a plurality of carton carriers 82 mounted at displaced locations along and between a pair of endless carton carrier conveyor chains 84 which extend lengthwise of the packaging machine and form an endless loop. The chains 84 pass over upstream and downstream conveyor chain sprockets 86 and 87 which are driven by means (not shown in FIG. 1), to be described hereinafter, in synchronism with the product pusher elements 66 and the carton blank conveyor 74. The direction of movement of the carton carriers 82 during operation of the machine is indicated by the arrows B in FIG. 1.

As the partially completed cartons approach the end closure mechanism 80 they pass a downstream end 88 of the trough 64 and the product bundle 50 is pushed off the end of the trough so that it comes to rest on the lower inside surface of the partially formed carton. The carton and the product bundle positioned therein continue to be moved along by the carton blank conveyor 76 and by one of the pusher elements 66. The action of the pusher elements 66 terminates at the forward sprockets 71; however, the carton blank conveyor continues movement of the carton blank along to the end closure mechanism 80. In the end closure mechanism the carton is engaged by one of the carton carriers 82, which is of U-shaped configuration and which straddles the sidewall of the carton as shown at **82*a* in FIG. 1. The carton carrier has end tab closure arms (not shown in FIG. 1) which close one each of the trailing and leading end tabs of the carton. The manner in which this takes place will be described more fully hereinafter. The carton carrier is then rotated by cam means, also to be described hereinafter so that the carton is pivoted by 90° as illustrated at 82*b* in FIG. 1. Thereafter the carton moves past various end tab and end flap closure plows (not shown) which complete the end closures of the carton. End flap adhesive applicators 90 are provided on both sides of the end closure mechanism 80 to apply adhesive to predetermined locations on the end flap so that they can be sealed together. The carton carriers 82 continue to move the completed filled cartons 55 to the end of the machine and deposit them on a platform 92** from which they may be removed by separate conveyor or in any other known manner.

The carton carriers 82 are thereafter carried along the upper reach of the chains 84 back to the forward end of the end closure mechanism 80 to receive other partially formed carton blanks. During this return movement the carton carriers 82 undergo a gradual reverse pivotal movement as indicated at **82*c*** so that they are properly oriented at the forward end of the end closure mechanism to receive a new partially formed carton.

Figure 2:
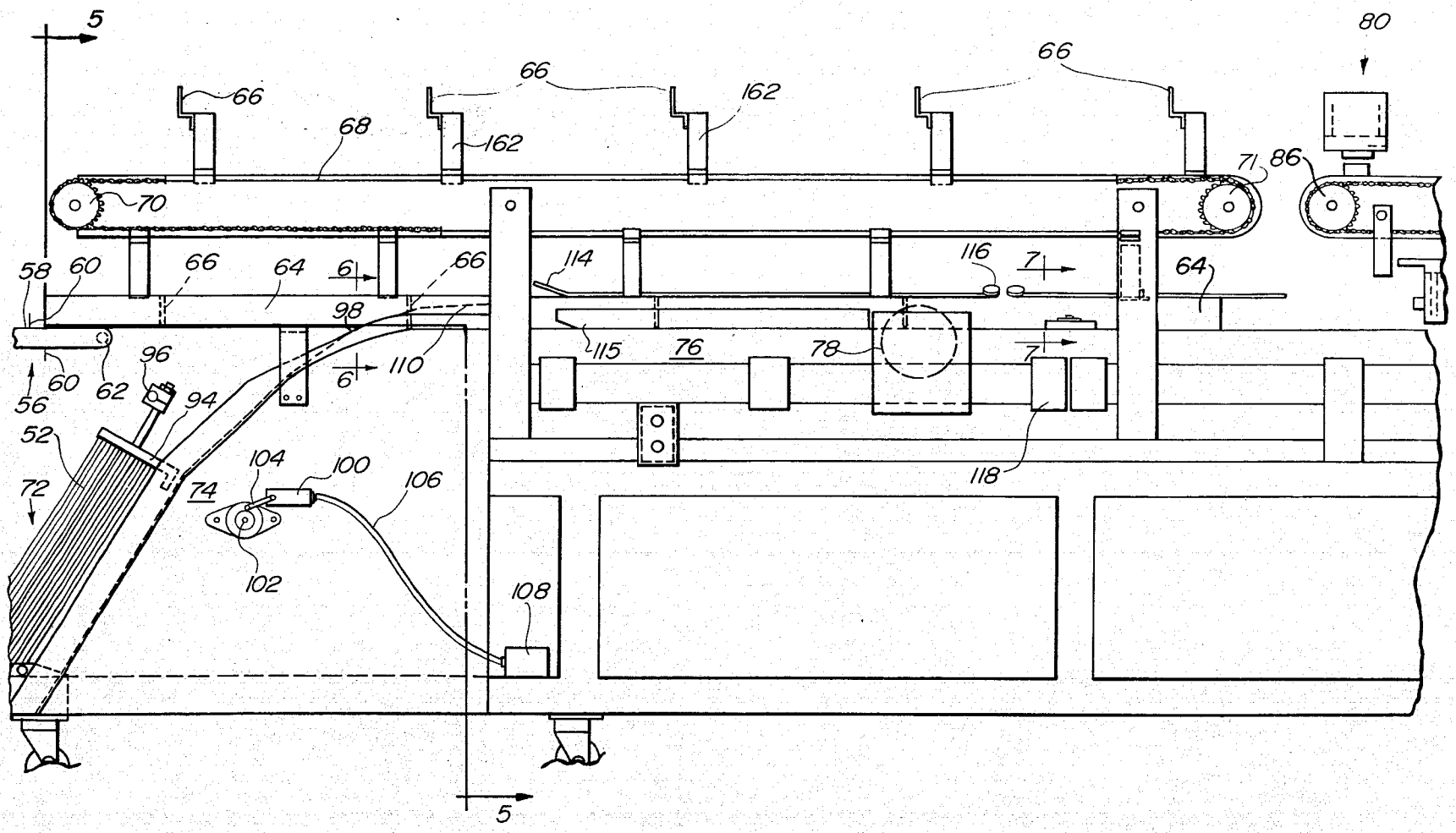
FIG. 2 is an elevational view of one side of a main panel forming portion of the machine of FIG. 1.
Figure 3:
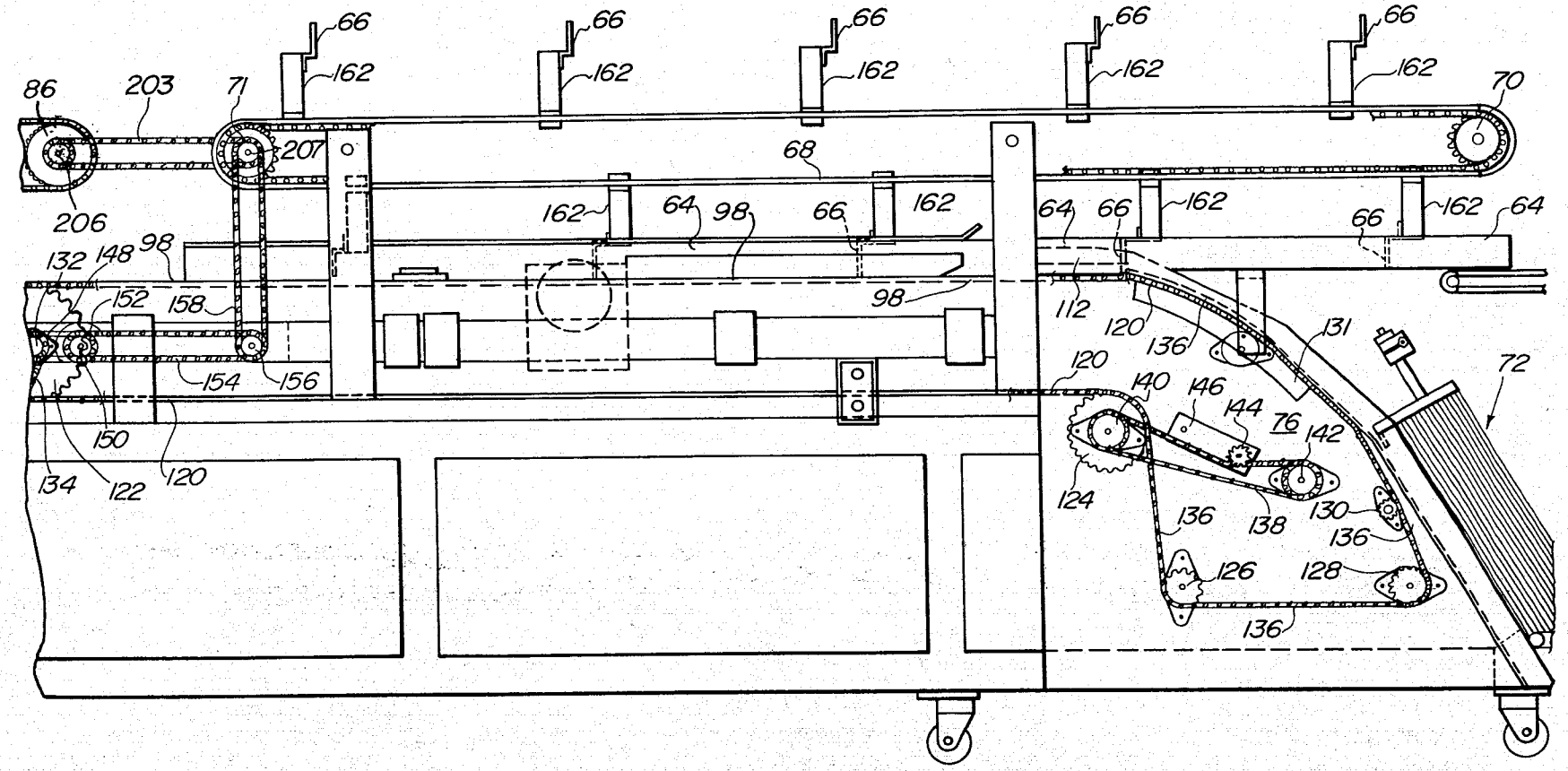
FIG. 3 is an elevational view of the opposite side of the main panel forming portion of FIG. 2.
Figure 4:
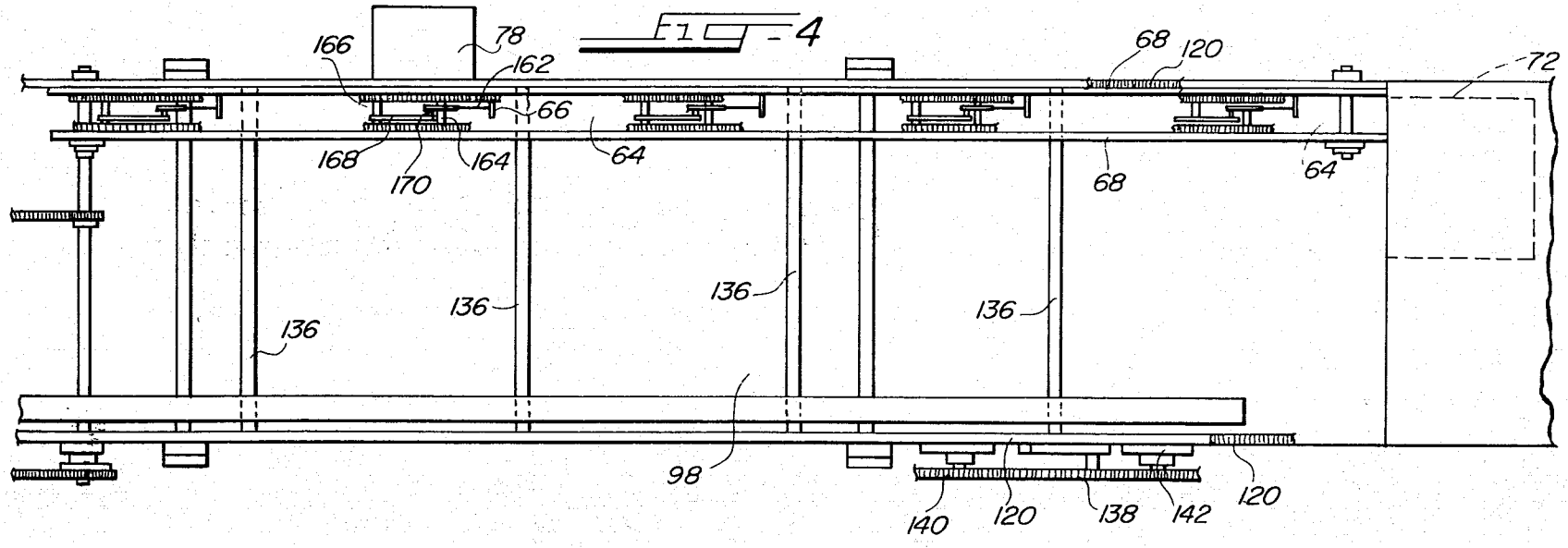
FIG. 4 is a top plan view of the main panel forming portion of FIG. 3.

FIGS. 2, 3 and 4 show in greater detail the general construction of the main carton forming portion 53 of the packaging machine of FIG. 1. As can be seen in FIG. 2 the flat carton blanks 52 are held in a stack slanted against the forward end of the carton blank feed mechanism 74. A stationary edge lip 94 is mounted in a clamp 96 to hold the upper edge of the carton blanks 52. Means (not shown) within the carton blank feed mechanism pulls down a flap of the carton blank immediately adjacent the edge lip 94 to disengage it from the lip and to fold the flap back against the blank. A puller bar, to be described later, moves up between the flap and main body of the carton and pulls the carton up along an upper surface 98 of the machine. As can be seen in FIG. 2, this upper surface is just below the stationary tough 64. The flap pulldown is initiated by means of an intermittently operated suction cup device, to be described. An air valve 100 on the side of the machine is operated in synchronism with the other parts of the machine by means of a rotary cam 102 in engagement with a follower 104 connected to the valve 100. An air line 106, leads from the valve 100 to a vacuum 100 to the suction cup.

A first plow element 110 extends up from the surface 98 just above the supply hopper 72. This first plow element serves to bend an edge seal flap of the carton blank 52 upwardly around the lower near corner of the trough 64 as viewed in FIG. 2. A second plow element 112 (see FIG. 3) is located on the opposite side of the machine at about the same distance therealong as the first plow element 110. This second plow element engages the outwardly extending portion of the carton blank on the far side of the trough 64 and introduces an upward bend around the lower far corner of the trough as viewed in FIG. 2. A third plow element 114, located downstream of the second plow element 112, introduced a lateral bend of 90° around the upper far edge of the trough 64 as viewed in FIG. 2 to bend the blank over top of the trough. A restraining wall 115 extends along the trough 64 to hold the edge seal flap in place until all of the carton panels have been bent around the trough 64. A side panel adhesive applicator 78 is located downstream of the third plow element 114 and this serves to apply a line of adhesive to the portion of the last side panel of the carton blank which contacts the edge seal flap when the panel bending is completed. A pair of ironing rolls 116 are located downstream of the adhesive applicator 78; and these ironing rolls engage the last side panel of the carton blank and bent it down into position so that its adhesive treated surface contacts the edge seal flap. This side panel and the edge seal flap are then squeezed together between the trough 64 and a pressure roll 118 to complete the main panel formation of the carton.

Turning now to FIGS. 3 and 4, which show the opposite side and the top, respectively, of the main carton forming portion 53 of the packaging machine, it will be seen that the carton blank conveyor 76 includes a pair of blank conveyor chains 120 which extend along each side of the machine in the form of endless loops. A plurality of blank conveyor chain sprockets 122, 124, 126, 128 and 130 and a chain guide member 131, are arranged to guide the blank conveyor chains so that they follow a path which passes along upwardly in the plane of the forwardmost carton blank in the supply hopper 72, and then along the upper surface 98 of the machine just under the trough 64. The forwardmost one of the blank conveyor sprockets 122 is keyed to a drive sprocket 132 which is driven through a drive chain 134 from a main system drive motor (not shown).

A plurality of puller bars 136 extend between and are attached to the blank conveyor chains 120. As will be described more fully hereinafter, these puller bars engage the carton blanks at folded under end flaps and pull the carton blanks up from the supply hopper 72 along the upper surface 98 of the machine. This movement of the carton blanks past the stationary plow elements 110, 112, 114 and 116 produces the actual bending over of the various blank panels.

A tab pulldown cam drive chain 138 is connected between a chain drive sprocket 140 mounted to turn with the blank conveyor chain sprocket 124 and a tab pulldown cam drive sprocket 142. An idler sprocket 144 is mounted on a pivot arm 146 and engages the chain 138 to maintain it in firm engagement with the sprockets 140 and 142. As can be seen the movement of the blank conveyor chains 120 causes the cam drive sprocket 142 to rotate in synchronism therewith. As will be described more fully hereinafter various cams and carton blank tab pulldown elements within the feed mechanism 74 are thus operated in synchronism with the movement of the puller bars 136.

Figure 13:
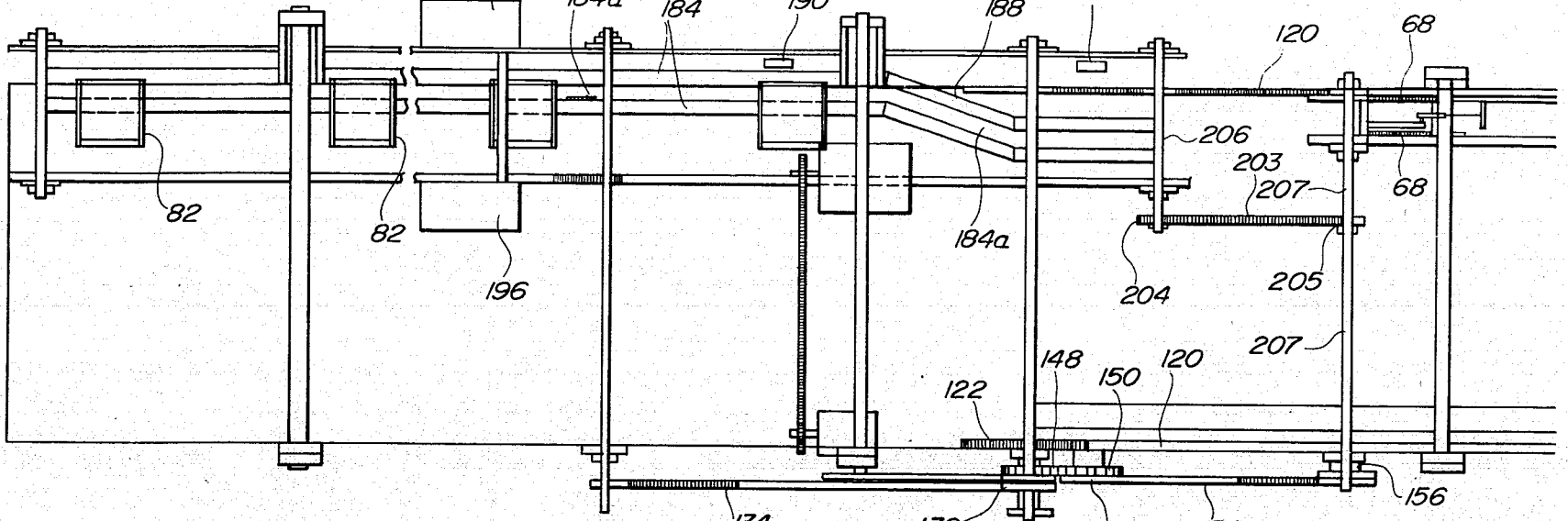
FIG. 13 is a view taken along line 13—13 of FIG. 10.

The pusher element chains 68, as can be seen in FIG. 3 and FIG. 13 are also driven indirectly from the drive chain 134. A pair of meshed reversing gears 148 and 150 are keyed, respectively, to the drive sprocket 132 and to a first lower drive sprocket 152. The first lower drive sprocket 152 is connected via a lower horizontal chain 154 to a second lower drive sprocket 156; and a similar sprocket, mounted coaxially therewith, is connected via a vertical drive chain 158 to an upper drive sprocket 160 coaxially mounted with the forward pusher element sprockets 70.

It will be appreciated from the foregoing that the driving action of the drive chain 134 will cause the upper reach of the blank conveyor chains 120 and the lower reach of the pusher element chains 68, and their associated puller bars 136 and pusher elements 66 to move together in synchronism from the receiving end of the machine toward the end closure mechanism 80. In this manner individual carton blanks and product bundles are maintained together during their passage along the main carton forming portion 53 of the machine.

The pusher elements 66 are mounted on the ends of pusher element arms 162 which extend out from the pusher element chains 68. As can be seen in FIG. 3 the pusher elements 66 are cantilevered out from the arms 162. This enables the pusher elements to extend inside the partially formed carton blanks 52 past their rearwardly extended trailing end flaps and tabs and into engagement with the product bundle 50 contained therein. This permits the product bundles 50 to be maintained in proper position over the bottom side panels of the carton blanks during their movement along the machine.

Figure 5:
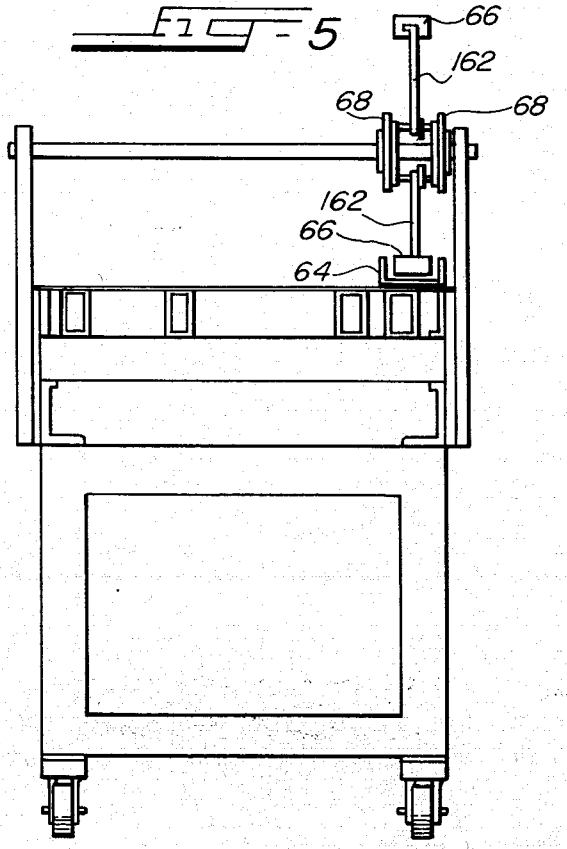
FIG. 5 is an elevational cross sectional view taken along lines 5—5 of FIG. 2.

Turning now to FIGS. 4 and 5, it will be noted that the blank conveyor chains 120 are located on opposite sides of the packaging machine so that the puller bars 136 extends across the entire width of the machine. The pusher element chains 68, however, are positioned close together and extend along one side of the machine over the stationary trough 64. This is because the machine itself must be sufficiently wide to accomodate the entire width of a flattened carton blank even though the trough 64 and the pusher elements 66 have a width of only one side of the filled and completed cartons.

FIG. 4 additionally shows the general manner of attachment of the pusher element arms 162 to the pusher element 68. As can be seen, the arms 162 are mounted on forward pivot bars 164 which extend crossways between the chains 68. Rearward pivot bars 166 also extend crossways between the chains a short distance behind the forward pivot bars 164. A control link 168 is pivotally interconnected between the rearward pivot bar 166 and a pivot 170 on the pusher element arm 162. As will be shown more fully hereinafter, this arrangement serves to produce an automatic retraction of the pusher elements 66 as their associated arms begin to move around the forward pusher element sprockets 71. This allows the pusher elements 66, which normally extend cantilever style, into the partially formed cartons, to pull back and clear the rearwardly extending trailing end tabs of the carton, as the pusher elements arrive at the end of their forward travel and separate from the partially formed cartons.

Figure 8:
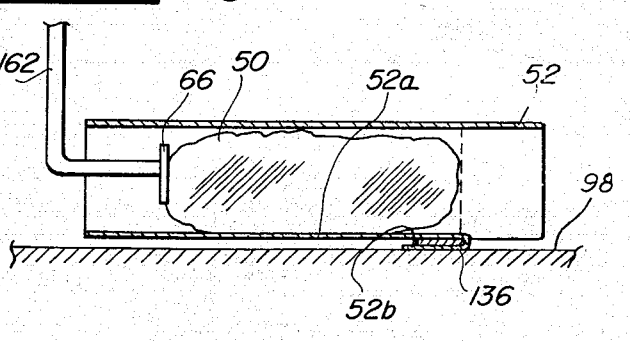
FIG. 8 is a sectional view taken along line 8—8 of FIG. 7.
Figure 7:
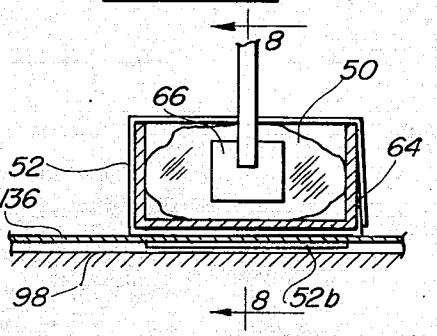
FIG. 7 is an enlarged fragmentary cross sectional view taken along line 7—7 of FIG. 2.
Figure 6:
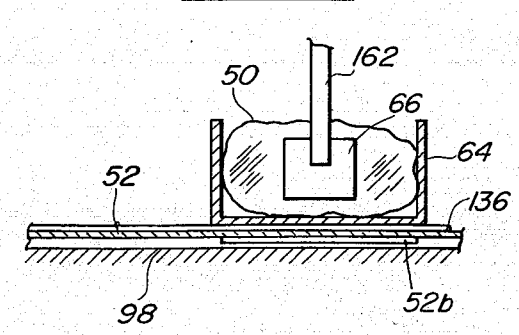
FIG. 6 is an enlarged fragmentary cross sectional view taken along line 6—6 of FIG. 2.
Figure 11:
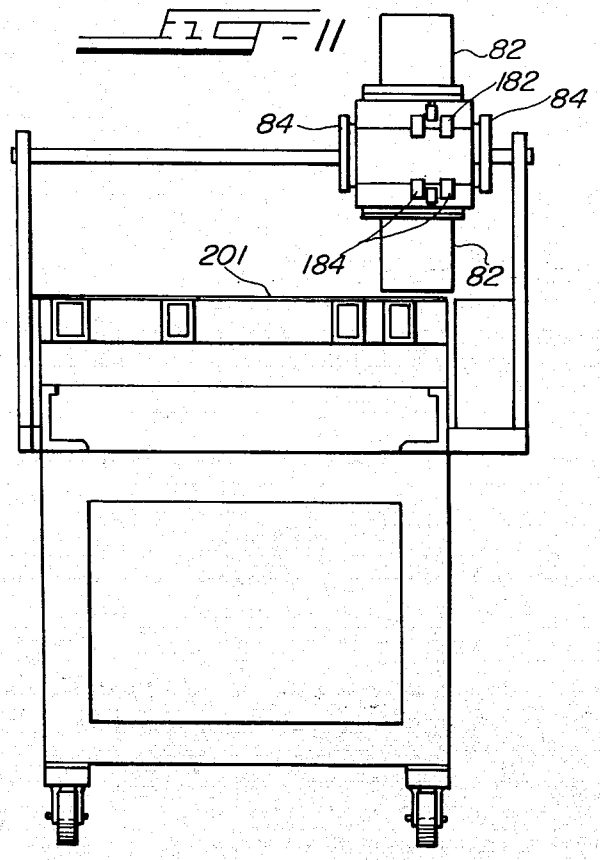
FIG. 11 is an elevational cross sectional view taken along line 11—11 of FIG. 10.

FIGS. 6, 7 and 8 illustrate the positional relationships of the carton blank 52, the product bundle 50, the trough 64, the pusher element 66 and the puller bar 136 in the main carton forming portion 53 of the machine. As can be seen in these drawings, the product bundle 50 is moved along inside the trough 64 by the pusher elements 66 while the carton blank 52 is pulled along the trough, i.e., between the trough 64 and the upper surface 98 of the machine, by means of the puller bar 136. As can be seen in FIG. 8, the puller bar 136 engages a corner formed by a bottom panel 52*a* and a bent back end flap 52*b* of the carton blank 52. The puller bar 136 is maintained close to the surface 98 and it thereby maintains the flap 52*b* in its bent back condition so that forward movement of the puller bar will produce a positive pulling effect on the carton blank.

As can be seen in FIG. 7, the carton blank 52 is bent around the outside of the trough 64 while the puller bar remains engaged with the blank between the bottom panel 52*a* and the bent back end flap 52*b*. The pusher element 66, as indicated above, is cantilevered out from its support arm 162 so as to maintain the product bundle 50 centered lengthwise in the carton blank. This relative lengthwise positioning is shown in FIG. 8.

The general construction and operation of the end closure mechanism 80 is best seen in FIGS. 9–13.

The cartons which are formed by the machine described herein are of rectangular cross section, having two wide panels and two narrow panels. End closure tabs are formed as extensions of the narrow panels and end closure flaps are formed as extensions of the wider panels. After the main panel portion of the carton has been formed as above described the ends of the carton are closed by bending the end tabs and flaps in over the ends of the carton. In general, the tabs are first bent in toward each other and then the flaps are bent in and sealed to each other and to the tabs to complete the carton.

As indicated above, the various carton carriers 82 of this mechanism engage the partially formed and filled cartons from the main carton forming portion 53 of the machine. These carton carriers first bend one of the end tabs at each end of the carton inwardly; and then they rotate the carton by 90° and convey it past various plow elements and adhesive applicators which serve to bend in the remaining end tabs and fold over the end flaps and seal them closed.

Figure 9:
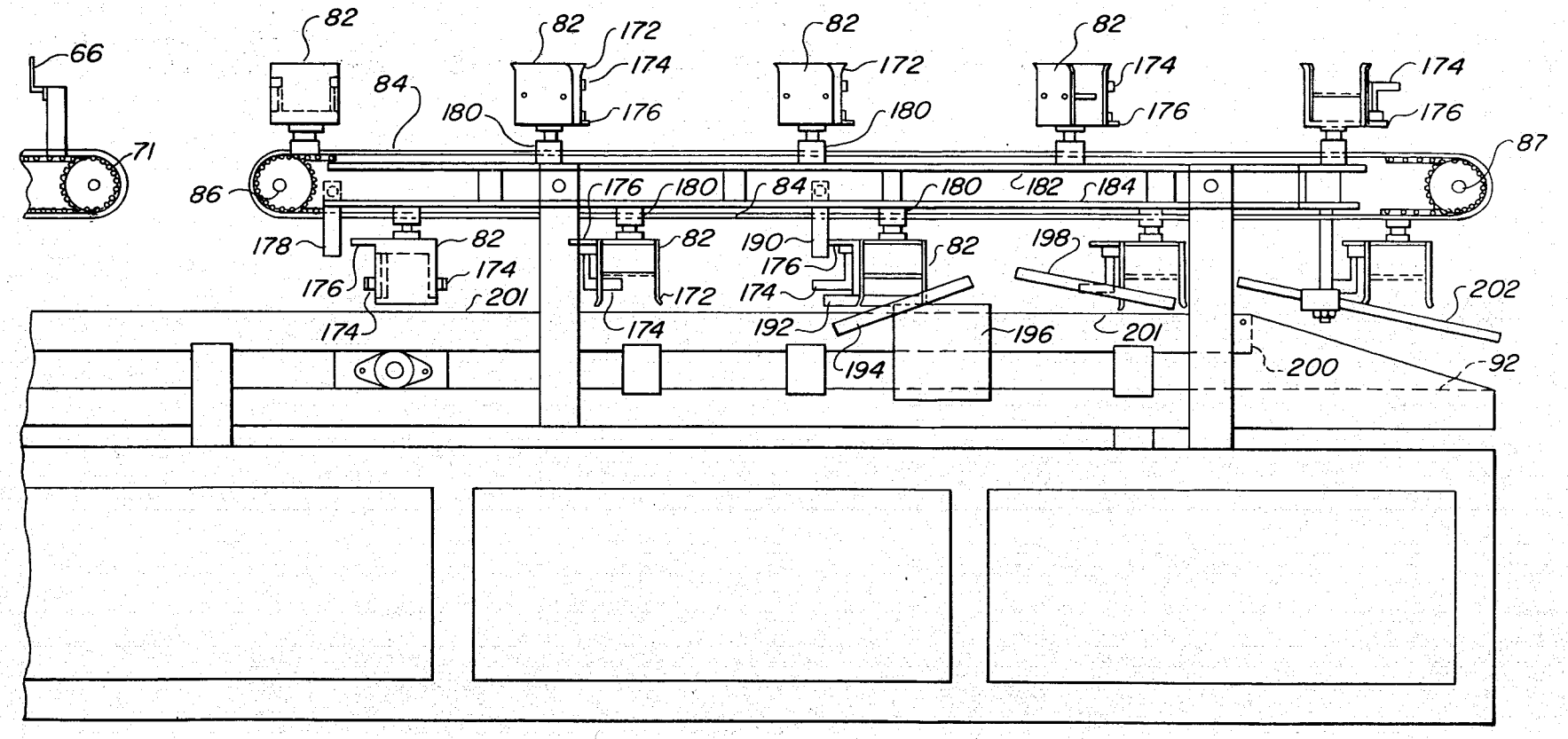
FIG. 9 is an elevational view of one side of an end closure portion of the machine of FIG. 1.
Figure 10:
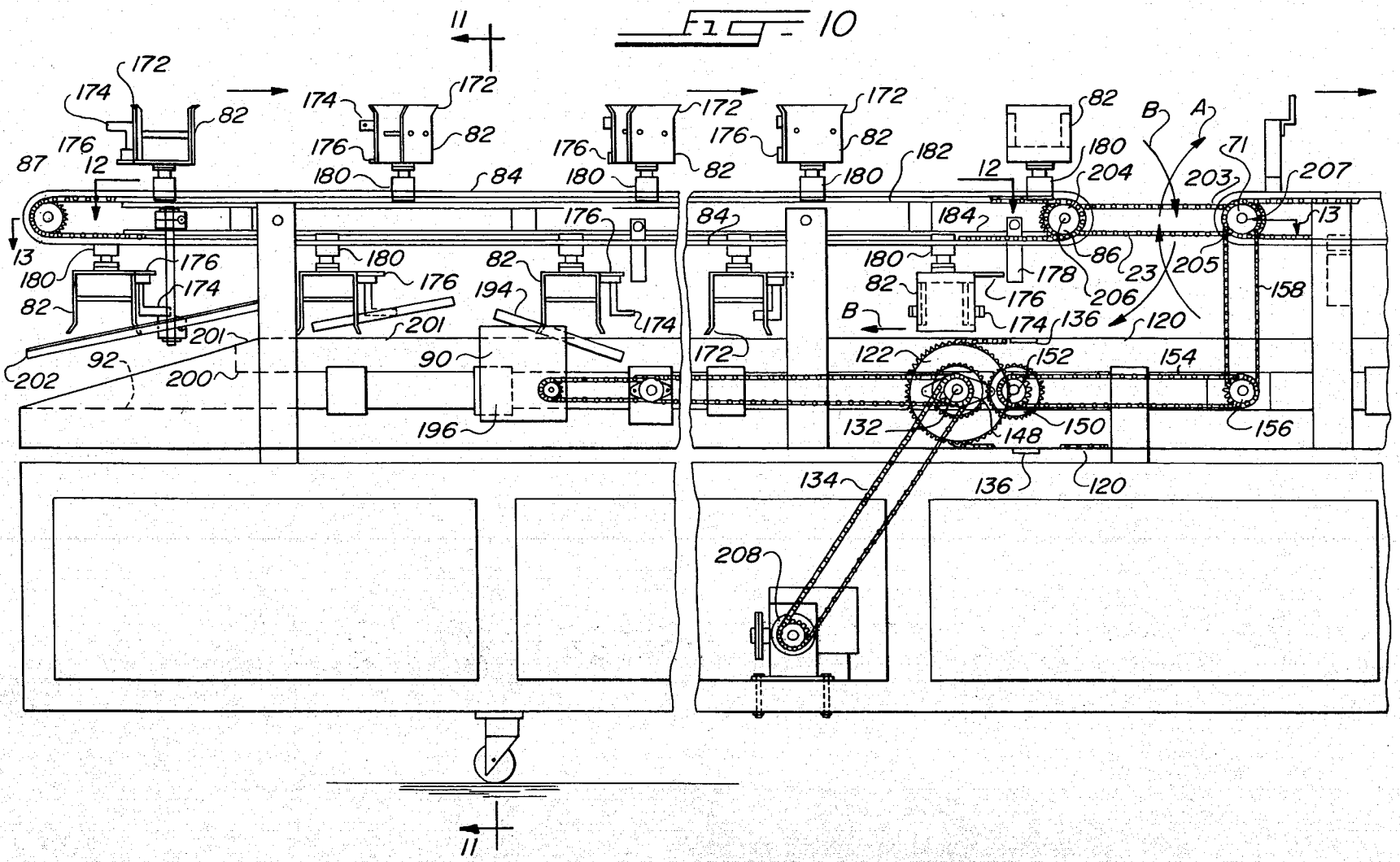
FIG. 10 is an elevational view of the other side of the end closure portion of FIG. 9.
Figure 12:
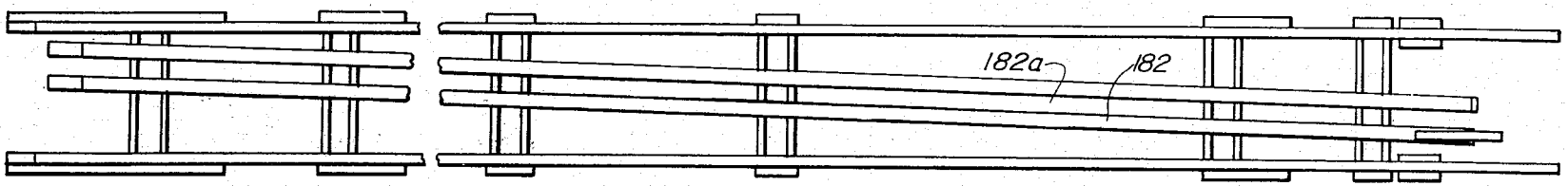
FIG. 12 is a view taken along line 12—12 of FIG. 10 and only showing the upper tracking paths.

As can be seen in FIGS. 9 and 10, the various carton carriers 82 are of generally U-shaped configuration, and they are curved outwardly along their outermost edges as indicated at 172. This enables the carriers to straddle the partially completed cartons across their width and hold them snugly without damaging them.

Each of the carton carriers 82 has mounted thereon a pair of swingable tab closure arms 174. Shortly after the carton carrier engages a carton, these arms swing from an opened condition to a closed condition during which one arm engages a trailing tab of the carton and the other arm engages a leading tab to bend the tabs inwardly to a closed position. The tab closure arms 174 are interconnected (in a manner to be described) with a cam follower 176 pivoted on the carriers 82, which controls the swinging movements of the tab closure arms. A first stationary cam actuator 178 is mounted near and just below the forward conveyor chain sprockets 86 to swing the cam follower 176 of each carton carrier 82 as it passes by after having just engaged a partially completed carton. This swinging of the cam follower 176 causes the tab closure arms 174 to engage one each of the trailing and leading end tabs of the carton and bend them inwardly over the ends of the container.

As can be seen in FIGS. 9–13, the carton carriers 82 are connected to the carton carrier conveyor chains 84 by means of connectors 180 arranged to allow the carton carriers to pivot about the axes which are perpendicular to the plane extending between the chains 84. Upper and lower sets of tracking bars 182 and 184 are mounted between the chains 84 along their upper and lower reaches respectively. Each set of tracking bars comprises a pair of bars parallel to each other and spaced apart laterally a short distance to define between them upper and lower tracking patch **182*a* and 184*a*. Follower elements (not shown) on the connectors 180 of the carton carriers 82 project into and follow the upper tracking path 182*a* as the carriers move along the upper reach of the chains 84 toward the receiving end of the machine; and these same follower elements project into and follow the lower tracking path 184*a* as the carriers move back along the lower reach of the chains 84. The lateral movement thus imposed upon the follower elements by the tracking bars 182 and 184 produces pivoting of the carton carriers 82**.

It will be noted from FIG. 13 that the lower tracking path **184*a* undergoes a sharp lateral shift as indicated at 188 just past the stationary cam actuator 178. This causes the carton carrier 82 and the partially completed cartons carried in them to swing around 90° just after the tab closure arms 174 have bent in the first of the carton end tabs as above described. This 90° rotation of the carton carrier 82 brings the carton itself around so that the remaining tabs and end flaps are in a position to be engaged and bent closed by various additional plow elements of the end closure mechanism 80**.

The lower tracking path **184*a* continues without lateral shift downstream of the region 188 and thereby maintains the carton carrier 82** and the cartons in them in proper alignment for completion of the end closures.

The upper tracking path **182*a* undergoes a gradual lateral shift over its entire length; and this serves to produce a gradual return rotation of the now empty carton carriers 82 as they move back along the upper reach of the chains 84. It will be seen that the lateral position of the downstream end of the tracking paths 182*a* and 184*a* corresponds to that of the corresponding upstream end of the other tracking path so that the follower elements on the carton carriers 82** follow the tracking paths over their entire path of travel.

As can be seen in FIG. 9 there is provided a second stationary cam actuator 190 downstream of the sharp lateral shift region 188 of the lower tracking path **184*a*. The cam actuator 190 is located in a position to be engaged by the cam followers 176 as their respective carton carriers move past the actuator. This produces a reopening of the swingable tab closure arms 174**.

A pair of end tab plows 192 are mounted to extend horizontally along the machine in the vicinity of the secondary stationary cam actuator 190 and just below the path of movement of the various tab closure arms 174. These end tab plows engage and cause inward bending of the remaining end tabs at each end of the carton as they are moved along by the carriers 82. Also, the end tab plows 192 serve to maintain the position of the initially bent in end tabs as the swingable tab closure arms 174 are swung back by the second stationary cam 190.

A pair of lower end flap folder plows 194 are mounted to extend along an upward inclination with respect to the machine in the vicinity of the downstream end of the end tab plows 192. These first end flap folder plows 194 serve to bend up the lower end flaps of the carton, and to cause these lower end flaps to maintain the end tabs folded in as they pass by the end tab plows 190.

A pair of end flap adhesive applicators 196 are located in the vicinity of the end flap folder plows 194 to apply a coating of adhesive to the outer surfaces of the lower folded up end flaps of the cartons.

A pair of upper end flap folder plows 198 are positioned on each side of the machine just downstream of the adhesive applicator 196; and these latter plows serve to bend down the upper end flaps of the cartons being carried by the carton carriers 82. This serves to complete the bending of the carton end flaps; and it also serves to seal them to each other to complete the end closure.

The thus completed cartons continue to be carried along the machine by the carton carriers 82 toward the output end of the machine. Eventually the cartons reach an end 200 of a bottom support 201. Beyond this point the cartons are free to fall down onto the lower dispensing platform 92 from which they may be collected or dispatched in any convenient manner. A pair of downwardly inclined pushdown bars 202 engage upper surfaces of the cartons being carried along in the carriers 82 and these bars cause the cartons to be released from the carrier so that the cartons can fall down onto the dispensing platform 92. The empty carton carriers 82 are then carried by the chains 84 around the sprockets 87 and back toward the pusher elements 66 to receive another carton.

As can be seen in FIGS. 10 and 13, the carton carrier conveyor chains 84 are driven from an upper horizontal drive chain 203 which extends between sprockets 204 and 205 mounted on associated axles 206 and 207, along with the sprockets 86 and 71 for the pusher elements 66 and the carton carriers 82. Thus the pusher elements and carton carriers are moved in synchronism along the machine.

The entire packaging machine is driven by means of a single drive motor 208 mounted below the various conveyors and chains. The motor 208 is coupled by means of the drive chain 134 to the drive sprocket 132. As set forth above, the drive sprocket 132 is keyed to the conveyor chain sprocket 122 and to the reversing gear 148. Thus, the motor 208 drives the blank conveyor via the sprocket 122 and the chain 120. At the same time it drives the product pushers 66 via the reversing gears 148 and 150 and the chains 154, 158 and 84; and it drives the carton carriers 82 via the gears 148 and 150 and the chains 154, 158, 203 and 84. It will be appreciated that because each of the elements which act on the carton blanks 52 and the product bundles 50, i.e., the puller bars 136, the product pushers 66 and the carton carriers 82, are all mechanically connected to the same drive motor, these elements operate in synchronism, so that accurate packaging of the product bundles is assured.

It will also be noted that the blank conveyor chain sprocket 86 is positioned between the first stationary cam actuator 178 and the sharp lateral shift region 188 of the lower tracking path 184*a*. Thus the puller bars 136 on the blank conveyor chains 120 maintain the partially formed cartons in synchronized movement until the carton carriers 82 with their swingable tab closure arms 174 come into positive drive engagement with the cartons. As the puller bars 136 move down around the forward ends of the sprockets 122 while the carton blanks continue to move horizontally along the bottom support 201 the puller bars become disengaged from the lower back folded end flaps; and in doing so the puller bars 136 at least partially unfold the flaps so that they may be returned to an extended condition and eventually refolded in the opposite direction by the lower end flap folder plows 194 to an end closing position.

Figure 14:
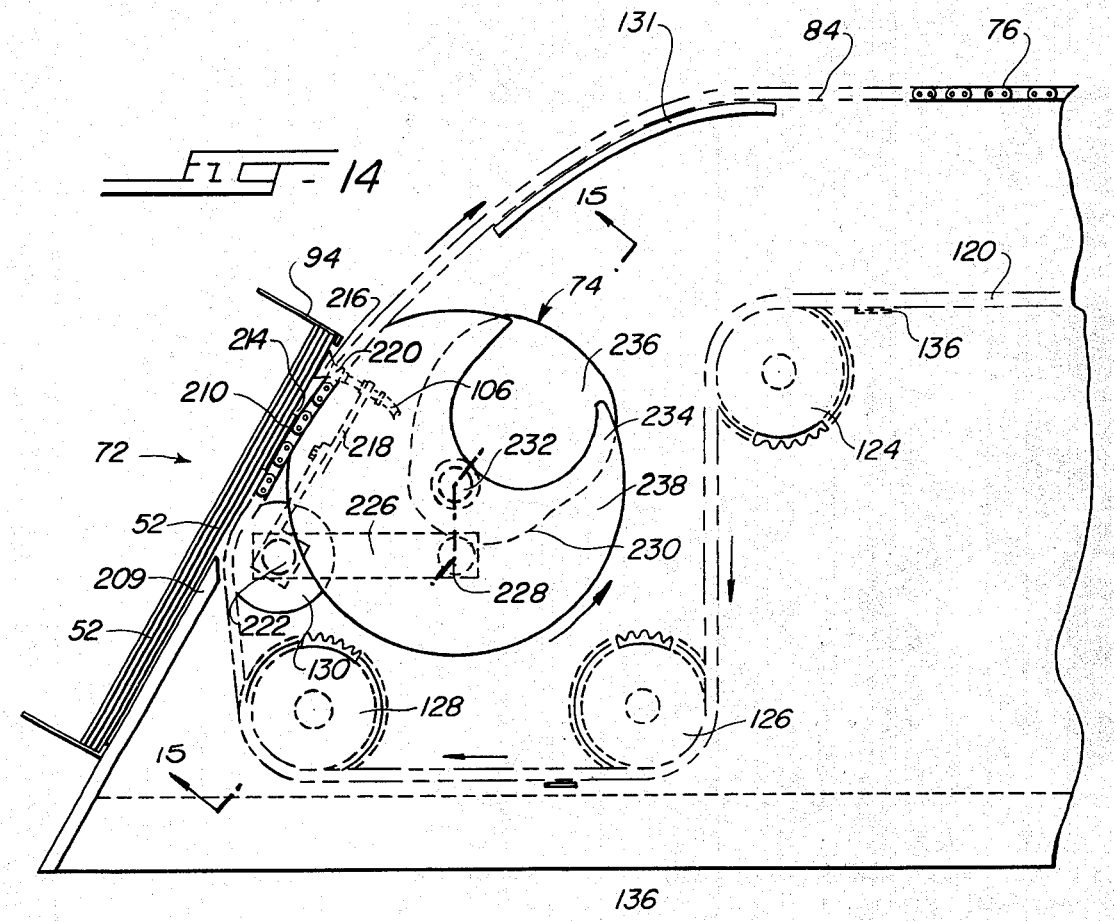
FIG. 14 is an enlarged side elevational view, partially cut away, showing a carton blank feeding mechanism of the embodiment of FIG. 1 at a first stage of operation.

The construction of the carton blank feed mechanism 74 and the manner in which it cooperates with the product feed conveyor 54 to separate individual carton blanks 52 from the stack in the carton supply hopper 72 and to deliver these carton blanks in precise orientation and spacing along the carton blank conveyor 76 is best seen in FIGS. 14–19. As can be seen in FIG. 14, the stack of carton blanks 52 lies against lower and upper support plates 209 and 210 which extend across the width of the machine at its receiving end. The blank conveyor chain sprockets 128 and 130, and the conveyor chain guide 131, on each side of the machine, guide the carton conveyor chain 120 such that in the vicinity of the support plates 209 and 210 the reaches of the chains 120 follow the plane of the blanks lying in the hopper. Actually, the chains 120 are on opposite edges of the support plates 209 and 210; however, the puller bars 136, which are carried by the conveyor, chains, and which extend across the machine, are caused to pass between the support plates and to move up along the outer surface of the upper support plate 210 between the plate and the facing surface of the immediately adjacent carton blank 52. From there, the puller bars 136 are carried along by the chains 84 up over the additional sprockets 212 and thence horizontally along the conveyor 76. During this movement of the puller bars 136 they engage a folded under end flap of the carton blank which lies immediately adjacent the support plates 209 and 210. The bars engage the blanks in this matter and carry them along over the carton blank conveyor 76.

The mechanism for producing folded under end flaps on the carton blank immediately adjacent the support plates 209 and 210 will now be described. As can be seen in FIG. 14, the carton blanks 52 extend a certain distance beyond the upper edge of the upper support plate 210. Actually this distance corresponds to the length of the end flaps of the carton blanks 52. A scored bend line 214 on the carton blanks, which define the separation of the main panel portions and the end tabs and flaps of the blanks, extends across the width of the blank in alignment with the upper edge of the upper support plate 210. The upper support plate serves as a form about which one end flap of each carton blank is bent back just before being engaged by a puller bar 136.

A suction cup 216 is mounted on one end of a suction cup arm 218 by means of a swivel or flexible connection 220. The other end of the suction cup arm is mounted on a pivot rod 222. The air line 106 is coupled to the suction cup. As mentioned above, this air line is selectively connected, via the air valve 100 (FIG. 2) to the vacuum source 108, thereby providing controlled pulling capability for the suction cup.

Figure 16:
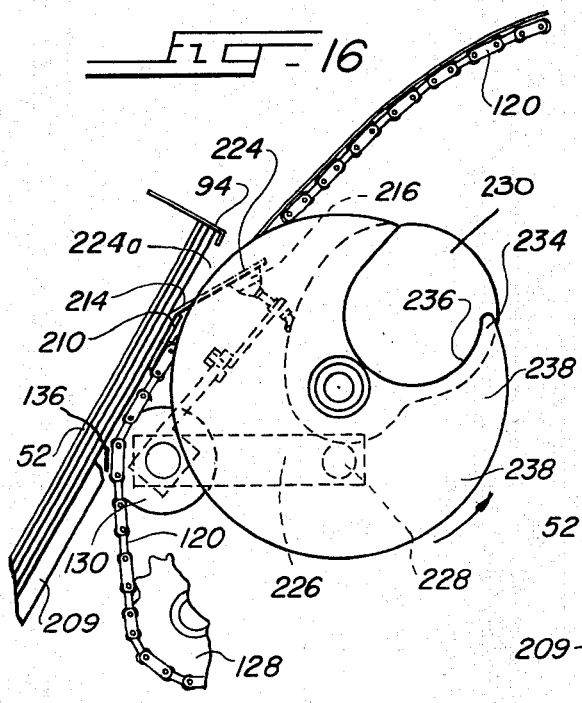
FIG. 16 is a fragmentary view of the blank feed mechansim of FIG. 14 in a second stage of operation.
Figure 17:
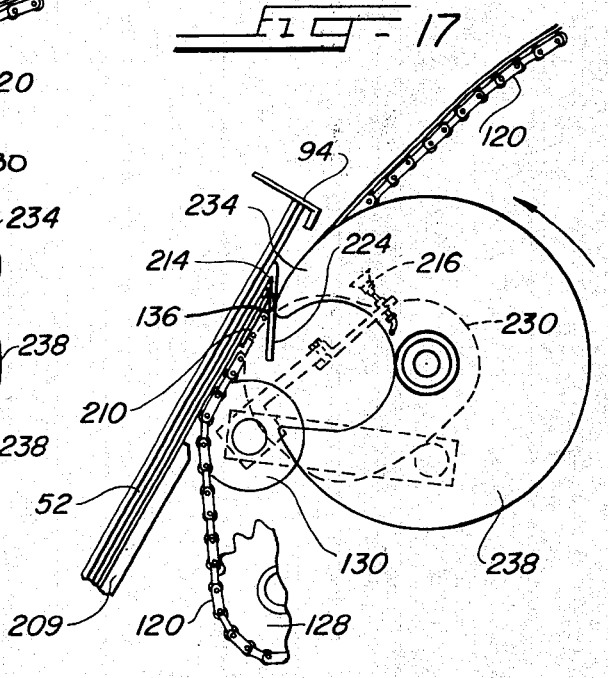
FIG. 17 is a fragmentary view of the blank feed mechanism of FIG. 14 in a third state of operation.

It will be noted from FIGS. 14, 16 and 17, that the pivot rod 222 and the arm 218 are arranged such that as the arm swings about the axis of the pivot rod 222, it causes the suction cup to move back and down from a position in full engagement with an unbended flap 224 of the adjacent carton blank 52 to a lower position, whereby, when the suction cup pulls on the flap, the flap becomes bent along its bend line 214 about the upper edge of the upper support plate 210. The swivel or flexible connector 220, as shown in FIG. 14, allows the suction cup 216 to remain in position flush against the flap surface during this movement. Actually the suction cup movement is continued in the backward direction by a substantial amount even after it has completed its flap pullback function. This permits the flap to pass by the suction cup when its bending is completed as will be described herein.

The backward movement of the suction cup 216 is produced by rotation of the pivot rod 222; and this in turn is controlled by the swinging of a cam follower arm 226 keyed at one end to the pivot rod 222. The other end of the cam follower arm 226 is provided with a follower element 228 which presses against the peripheral surface of a rotary cam 230 keyed to a camshaft 232 which is also keyed to the tabpulldown cam drive sprocket 142 as shown in FIG. 3. During operation of the machine, as shown in FIG. 3, the movement of the carton conveyor chains 120 around the pulleys 124 serves to turn the chain drive sprocket 140; and this causes the tab pulldown drive chain 138 to turn the tab pulldown cam drive sprocket 142 and the camshaft 232 to rotate the rotary cam 230 in synchronism with the movement of the chains 120 and the puller bars 136. The rotary cam 230 is shaped to move the follower element 228, the cam follower arm 226 the pivot rod 222, the suction cup arm 218 and the suction cup 216 so that the suction cup engages an unbent adjacent carton and flap 224 and pulls it back and down once each time a puller bar 136 passes up between the lower and upper support plates 209 and 210 and up along the outer surface of the upper support plate. At the same time the rotary cam 102, which is also keyed to the camshaft 232 operates the air valve 100 in such a manner that the suction cup 216 is connected to the vacuum source 108 and is thereby rendered capable of pulling back or the carton and flap 224 during this backward movement. As can be seen in FIG. 16 this pulling action releases the end flap 224 from the edge lip 94, and forms an open space 224*a* between the partially bent edge flap 224 and the corresponding edge flap of the next adjacent carton blank.

Figure 15:
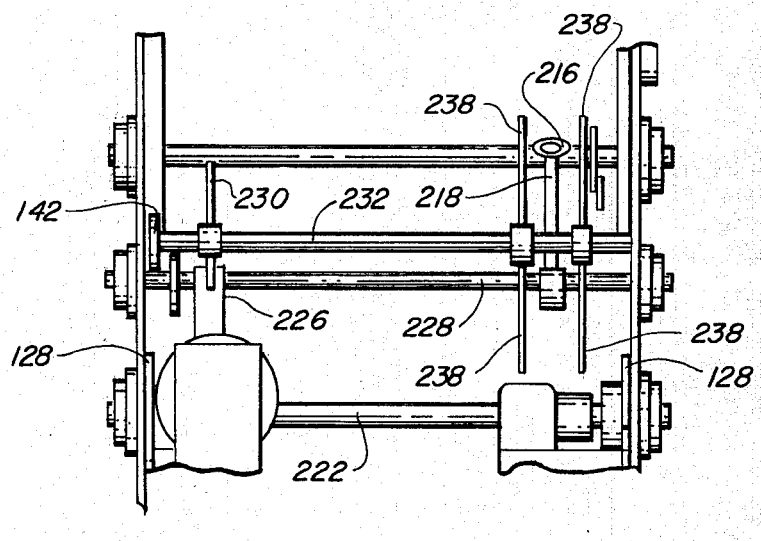
FIG. 15 is a section view taken along line 15—15 of FIG. 14.

Following the partial pullback of the carton end flap 224 as above described, the upper, now exposed, surface of the end flap 224 is engaged, as shown in FIG. 16, by pushdown fingers 234 formed by cutouts 236 at the periphery of pushdown discs 238. As can be seen in FIG. 15 there are provided two such pushdown discs 238 arranged in axially spaced apart relation along the camshaft 232 on opposite sides of the path of movement of the suction cup 216. When the pushdown fingers 234 engage the carton end flap, the rotary cam 102 (FIG. 2) operates the air valve 100 to disconnect the suction cup 216 from the vacuum source 108. The suction cup releases from the partially bent back end flap 224, and continues to swing back, under the influence of the rotary cam 230, so as to allow room for the continued bending of the flap.

Figure 18:
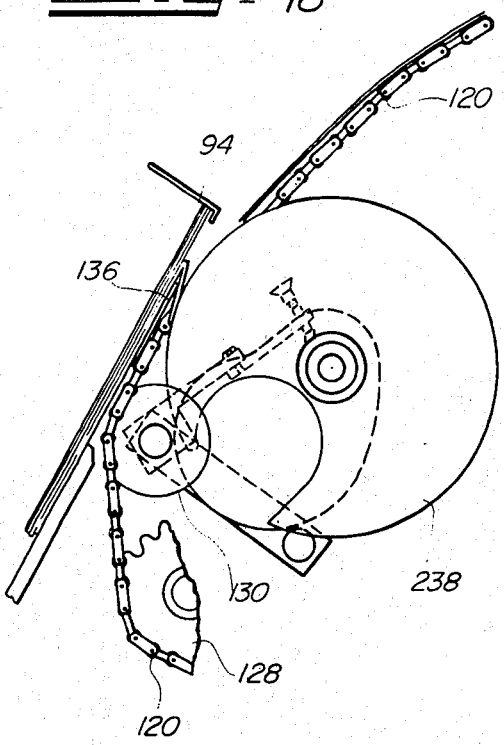
FIG. 18 is a fragmentary view of the blank feed mechanism of FIG. 14 in a fourth stage of operation.
Figure 19:
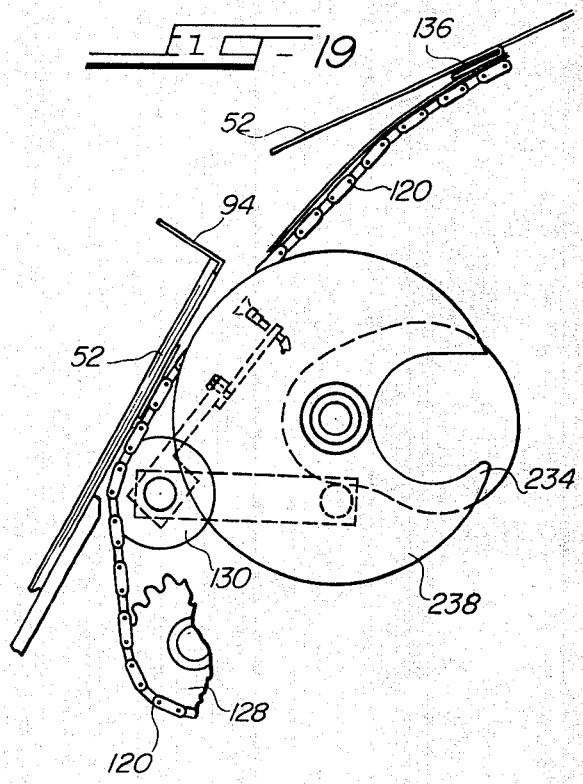
FIG. 19 is a fragmentary view of the blank feed mechanism of FIG. 14 in a fifth stage of operation.

The downward movement of the pushdown fingers 234 forces the partially bent back carton end flap 224 further back and around so that it becomes sharply bent along its bend line 214 over the upper edge of the upper support plate 210 as shown in FIG. 17. Continued rotation of the pushdown discs 238 causes their outer peripheries to engage the fully bent back carton end flap 224 as shown in FIG. 18 and to maintain it in such position. The carton end flap 224 is thus held in bent back position until one of the puller bars 136 passes up between the outer surface of the upper support plate 210 and the facing surface of the carton blank itself. Eventually the puller bar reaches the bend line 214 between the main body of the carton blank 52 and its bent back end flap 224. Continued movement of the puller bar 136 pulls the carton blank out from the stack in the supply hopper 72 and carries it along the carton blank conveyor 76 as shown in FIG. 19.

The movement of the carton blanks 52 and the product bundles 50 during package formation can be more easily visualized from the perspective views of FIGS. 20*a*, 20*b* and 20*c*. FIG. 20*a* shows an individual carton blank 52 in essentially flattened condition but having one end flap 224 bent back under the blank along a bend line 214 to provide a positive engagement for one of the puller bars 136. As the puller bar 136 moves along the carton blank conveyor 76, it pulls the carton blank 52 in proper orientation and position for the accurate formation of a finished carton. It will be appreciated that because the puller bar 136 engages the carton blank along the entire length of the end flap 136, the resulting pulling stresses on the blank are minimized. Also, the engagement of the puller bar 136 along the bend line 214 ensures that the carton blank will remain in proper alignment during the various panel bending operations.

As indicated by dashed lines in FIG. 20*a*, the carton blank is prescored along the leading and trailing lateral bend lines 240 and 241 and four longitudinal bend lines 242*a–d* which extend between the lateral score lines. The blank is also slit along leading and trailing longitudinal slit lines 244 and 245 which form extensions of the longitudinal score lines 242 outside the lateral score lines 240 and 241. As can be seen, the end flap bend line 214 is an extension of the leading lateral score line 240. The score lines 240, 241 and 242 divide the blank into two wide panels 246 and 248 and two narrow panels 250 and 252 as well as an edge seal flap 254. The leading lateral score lines 240 (along with its extension 214) and the leading longitudinal slit lines 244 form the bent back end flap 224, a pair of leading end tabs 256 and 257 and a further leading end flap 258. Similarly, the trailing lateral bend line 241 and the trailing longitudinal slit lines 245 form a pair of trailing end flaps 260 and 261 and a pair of trailing end tabs 262 and 263.

As the puller bar 136 moves the carton blank 52 along the blank conveyor 76 just under the trough 64, a product bundle 50 is moved along through the trough by means of one of the pusher elements 66 (not shown in FIG. 20). As the blank engages the first and second plow elements 110 and 112, the edge seal flap 254 is bent up around the trough 64 along the first longitudinal bend line 242*a* while the narrow side panel 252, along with the wide side panel 246 and the remaining narrow side panel 250, and associated tabs and flaps, is bent upwardly around the opposite side of the trough 64 along the second longitudinal bend line 242*b*. Thereafter the carton blank 52 engages the third plow element 114 which bends the carton blank about its third longitudinal bend line 242*c* thereby bringing the wide side panel 246 back across the top of the trough 64. At this point the underside of the narrow panel 250 is engaged by the adhesive applicator 78 which applies a line of adhesive along the outer edge of the panel.

After passing the adhesive applicator 78, the carton blank 52, as shown in FIG. 20*b*, is engages by the ironing rolls 116 and these serve to bend the panel 250 down about the upper bear edge of the trough 64 along the fourth longitudinal bend line 242*d*. This brings the adhesive coated portion of the panel 250 into contact with the upwardly bent edge seal flap 254. These elements are then pressed together between the trough 64 and the presser roll 118 as the carton blank moves along; and during this time the adhesive sets so that the carton blank becomes permanently formed into a tubular configuration encircling the product bundle 50.

Following completion of the side panel bending and sealing operations described above, the partially completed carton continues to be advanced along the machine by the pulling action of the puller bar 136. However, since the carton blank now surrounds the product bundle, and since the blank is sufficiently formed to maintain its given shape, it is no longer necessary for the product bundle 50 to be separately moved along inside the trough 64. The trough therefore terminates a short distance beyond the presser roll 118; and the product bundle 50, upon reaching the end of the trough 64, simply continues along being carried inside the partially completed carton.

The puller bar 136 continues to move the partially completed carton blank 52 with its product bundle 50 until the carton blank becomes engages by one of the carton carriers 82 (not shown). Very shortly after this engagement takes place, the swingable tab closure arms 174 pivot around to engage and bend over the tabs 257 and 263. Besides closing these tabs, this action of the tab closure arms 174 provides positive engagement between the carton carrier 82 and the carton. The movement of the puller bar 136 is thus no longer needed to move the carton along and the bar simply moves around the sprockets 122 (FIG. 3) down and away from the carton. The closure of the arms 174 also serves to recenter the product bundle 50 inside the carton. At this point the package consisting of the partially formed carton blank 52 and the product bundle 50 enclosed thereby, is under the exclusive control of the carton carrier 82.

The cartons are then rotated 90° about a vertical axis V (as indicated by an arrow W in FIG. 20*b*); and this brings the narrow side panel 250 and its associated, still extended, end tabs 256 and 262 into leading positions along the path of carton movement.

As the carton continues to move, as illustrated in FIG. 20*c*, the end tabs 256 and 262 engage the end tab plows 192 and are closed thereby. These plows also retain the previously closed tabs 251 and 263 in closed condition so that the tab closure arms 174 can swing back to an open position.

The carton next moves by the lower end flap folder plows 194 which engage the end flaps 224 and 261 and bend them upwardly against the previously bent in end tabs 256, 257, 262 and 263. At this point the end flap adhesive applicators 196 apply a line of adhesive to the underside of the remaining end flaps 258 and 260. Finally, the upper end flap folder plows 198 engage these end flaps and cause them to be bent down and pressed against the other end flaps and tabs to complete and seal the carton. The now completed carton is then removed from the machine as described above.

FIGS. 21 and 22 illustrate how the particular construction and mounting of the pusher elements 66 serves to provide an automatic retraction of the elements from within the partially formed carton blanks before the pusher elements move around the sprockets 71. As can be seen in FIG. 21, in order to maintain a product bundle 50 positioned centrally within the panel region of the partially completed carton blanks 52, it is necessary for the pusher elements 66 to extend into the open end of the blank, past the various extended end flaps 260 and 261. Accordingly, the pusher elements 66 are cantilevered out by means of extenders 264 which project forwardly from the ends of the arms 162. Now, since the arms 162 project out in a generally perpendicular direction from the pusher element chains 68, their continued movement in this relationship to the chains would, as they begin to circle around the sprockets 71 cause them to interfere with the upper end flap 260 of the carton blank. Because of this, it is necessary to provide some retraction of the pusher elements 66 just before they begin to move up and around the sprockets 71. This retraction is obtained automatically and in a simple manner in accordance with the present invention by means of the mounting arrangement shown in FIGS. 21 and 22. As can be seen in these drawings the pusher element arm 162 is pivotally connected, via the forward pivot bar 164, to a first location along the length of the chains 68. The arm 162 extends a distance beyond the chains 68 to the pivot point 170 where the arm 162 is pivotally connected to one end of the control link 168. The other end of the control link is pivotally connected, via the rearward pivot bar 166, to a second, trailing, location along the length of the chains 68.

As the portion of the chains 68 carrying the pusher elements begins to move around the sprockets 71, the distance between the forward and rearward pivot bars 164 and 166 decreases because the portion of the chains 68 between them becomes bent about the circumference of the sprockets 71. As a result of the pivot bars 164 and 166 coming closer to each other, the control link 168 pushes forwardly on the upper end of the pusher element arm 162 causing the arm to swing back. The arm 162 thus retracts the pusher element 66 and maintains it so retracted until it passes around the sprocket 71 and the chains 68 again extend to a straightened condition. The path of the pusher element 66 at various stages during this movement is indicated by various rectangles 66′ in FIG. 21.

The construction and mounting arrangements for the carton carriers 82 is best seen in FIGS. 23–26. As can be seen in these drawings, the carton carriers 82 are each formed of sheet metal bent to form a U-shaped channel having a base 266 and a parallel side 268. The sides 268 terminate in the outwardly curved outer edges 172. The dimensions of the carrier are such that it snugly but not tightly fits about a partially formed carton blank 52 as indicated in phantom outline in FIG. 23.

The base 266 of the carton carrier 82 is bolted or otherwise fastened to a mounting plate 270 and this in turn is secured to an upper pivot plate 272. The pivot plate 272, along with a lower pivot plate 273, is connected, via a bearing 274, to a mounting bracket 276. The mounting bracket 276 comprises a longitudinal portion 278 which extends longitudinally in the direction of the chains 84, and a forward lateral portion 280 (FIG. 24) which extends between the chains. The ends of the forward lateral portion are attached, by means of forward clips 282, to the chains 84 in a manner allowing pivotal movement of the forward lateral portion. The trailing end of the longitudical portion 278 is formed with an open longitudinal slot 284; and this engages a rearward lateral member 286 which also extends laterally between the chains 84. This rearward lateral member is secured to the chains 84 by means of rearward clips 288. The purpose for the slot 284 is to accomodate movement of the forward lateral portion 278 of the mounting bracket 276 toward and away from the rearward lateral member as the chains 84 pass around their respective sprockets.

The bearing 274 includes a journal element 290 fastened by bolts 292 to the side of the longitudinal portion 278 of the mounting bracket 276. The journal element 290 cooperates with the longitudinal portion 278 to support a vertical pivot stud 293 about which the pivot plates 272 and 273 may turn. The pivot plates 272 and 273 are connected together on one side of the longitudinal portion 278 of the mounting bracket by means of a spacer 294. A follower extention 298 extends down from the lower plates 273 on the opposite side of the longitudinal portion; and this extension terminates in a follower element 297. As pointed out in connection with FIGS. 9–13, the cam follower extends into the tracking paths 182*a* and 184*a* defined by the upper and lower tracking bars 182 and 184. It will be noted in FIG. 23 that the follower element 297 is offset with respect to the pivot axis of the bearing 274. As a result, lateral movements of the follower element 297, as it moves along the tracking paths 182*a* and 184*a*, causes rotation of the mounting plate 270, the upper and lower pivot plates 272 and 273 and the carton carrier 82 as indicated by the arrow G in FIG. 24.

As shown in FIGS. 23, 25 and 26, the swingable tab closure arms 174 are mounted on closure arm shafts 298 which extend along one of the sides 268 of the carton carrier 82 near its edges. The shafts 298 are journaled to rotate in a mounting bar 300 which is bolted to the side 268. The cam follower 176 is keyed to one of the shafts 298 below the mounting bar 300.

The two closure arm shafts 298 are coupled for synchronous movement between opened positions, as shown in FIG. 25 and closed position, as shown in FIG. 26, by means of a chain 302 arranged in a figure eight configuration around sprockets 304 keyed to the two closure arm shafts. A portion of the chain 302 is made up of a tension spring 306 in order to maintain the chain in positive and firm engagement with the sprockets 304.

The cam follower 176, as can be seen in FIGS. 25 and 26, is arranged to extend into the path of the first and secondary stationary cam actuators 178 and 190 as the carton carrier 82 moves along the packaging machine in the direction of the arrow L. It will be appreciated that the carton carrier rotates through a 90° arc, as described above in connection with FIGS. 9–13, between cam actuators 178 and 190; and this can be seen in the positions in which the carrier 82 is shown in FIGS. 25 and 26.

It will be appreciated that the above described carton carrier and its rotation control arrangement permits a great degree of flexibility in regard to the shape of packages to be formed. For example, by modification of the lower tracking path 184*a* the carton may be rotated stepwise through several increments as it moves along the end closure mechanism 80. If the carton is to have a polygonal shape, e.g., a hexagon or an octagon, each of the different carton sides may be aligned successively with flap closure plows along the length of the machine.

In certain instances, for example where the length of the finished carton is to be several times greater than its other dimensions, it may not be practical to rotate the carton for the closing of its end tabs and flaps. The embodiment of FIG. 27 permits the closure of these end tabs and flaps without rotation of the carton. Instead, as can be seen in FIG. 27, there is provided an end closure mechanism 310 which comprises a conveyor arranged at right angles to a main carton forming portion 312 of the machine. The main carton forming portion 312 comprises a product feed conveyor 314 which delivers product bundles 316 to a trough 318 through which the bundles are moved by pusher elements 320 while carton blanks 322 are conveyed along and bent around to encircle the product bundles. The pusher elements 320 are mounted on pusher element chains 324 in the same manner as in the preceding embodiment; and the carton blanks 322 are carried along a carton blank conveyor 326 under the trough 318 in the same manner as in the preceding embodiment. In the present embodiment a continuous elongated plow 328 is provided to engage the carton blank after the first bending operation; and this plow bends the blank, first across the top of the trough and then down over its near side to cause the carton to encircle the trough. An adhesive applicator 330 is provided near the downstream end of the plow 328 to apply an adhesive to the carton for sealing same in its product encircling configuration.

An end tab closure arrangement is provided in the vicinity of the continuous elongated plow 328. This end tab closure arrangement comprises a plurality of end tab closure fingers 334 mounted on a loop which passes around pulleys, sprockets or the like 332 so as to extend alongside the path of carton movement along the machine. The tab closure fingers 334 are arranged to flip about vertical axes, as indicated by the arrows M, so as to engage and close extended end tabs or the carton blanks as the fingers 334 are carried along in synchronism with the carton blanks. The end tab closure arrangement terminated ahead of the end of the main carton forming portion 312 of the machine.

A cross conveyor 336 is mounted to extend at a right angle to the main carton forming portion 312. This cross conveyor includes carton pusher elements 338 mounted on chains 340 in the form of endless loops. The chains 340 pass over sprockets 341 and 342 mounted above the conveyor; and they are driven in synchronism with the various chains and other conveyor elements of the main carton forming portion 312.

Various plow elements 345 and 346 and an adhesive applicator 348, are positioned along each side of the cross conveyor 336. These elements bend, close and seal the various end tabs and flaps of the cartons moving along the conveyor thereby completing the packaging operation.

The carton blanks 322 are moved along the main carton forming portion 312, as in the preceding embodiment, by means of puller bars 350 which engage the carton blanks along inside corners formed between the underside of the blank and a bent under end flap. These puller bars are moved along by means of a pair of conveyor chains 352 which pass over sprockets 354 at the downstream end of the main carton forming portion 312.

When the carton blanks 322 carring the product bundles 316 reach the downstream end of the main carton forming portion 312, instead of being rotated by 90° and carried along the same path for engagement with end tab and flap closure plows as in the preceding embodiment, they are merely moved, without rotation, along a new path which itself extends 90° relative to that of the main carton forming portion. This arrangement avoids difficulties which may otherwise be encountered in the rotation of thin elongated cartons such as those used to package stacks of paper cups.

It will be noted that the bottom surface of the blank conveyor 326 is formed with an opening 356 in the vicinity of the cross conveyor 336. This opening permits the carton blanks to become released from the puller bars 350 so that they may be moved laterally along the cross conveyor 336 by the pusher elements 338. When the carton blanks reach the opening 336 their bent back end flaps are allowed to extend down and then swing back to an unbent forwardly extended position free of the puller bar. The natural resiliency of the carton material and the forward movement of the puller bar 350 serves to produce this unbending. Once the carton blanks have been thus released from the puller bars they are free to be pushed laterally along the cross conveyor 336 between the various plow elements for completion of the end closures.

FIGS. 28–32 illustrate a modified carton blank feed arrangement which may be used in the embodiment of either FIG. 1 or FIG. 27. As shown in FIG. 28, the carton blanks 322 rest in a stack against a support plate 358. The support plate has an upper edge 360 aligned with a flap bend line 362 of the carton blanks so that as end flap 364, which extends up above the plate, can be bent back down over the edge and around the plate.

A suction cup 366 is mounted on one end of a suction cup arm 367 which is mounted by means of a first fixed pivot 368 on the machine. A suction cup control link 370 is pivotally connected between an intermediate location 372 on the suction cup arm 367 and a swinging end of a cam follower arm 374. The other end of the cam follower arm 374 is mounted by means of a second fixed pivot 376. A cam follower 378, located along the arm 374, rests against the periphery of a suction cup movement control cam 380 which in turn is rotated about an axis 382 by means of a chain 384 coupled to a conveyor chain sprocket 386. The conveyor chain sprocket 386 is driven via the conveyor chains 352 and these in turn are driven from a drive sprocket 388 coupled via a drive chain 390 to a main drive motor 392.

A flap push down element 394, of sheet like configuration and bent to a slight arc, is mounted on the end of a push down arm 396. This push down arm, in turn, is mounted by means of a third fixed pivot 398 on the machine. A push down control link 399 interconnects the push down arm 396 and a push down follower arm 400. The push down follower arm is mounted by means of a fourth fixed pivot 402 on the machine, and it is provided with a follower 404 which rests on the periphery of a push down cam 406. The push down cam in turn is mounted to rotate with the suction cup control cam 380. Finally, a suction control cam 408 is mounted to turn with the drive sprocket 388. This cam operates a suction control valve 410 to control application of vacuum to the suction cup 366.

The overall operation of the carton blank feed arrangement of FIG. 28 is similar to that previously described. As the motor 392 drives the sprocket 388, the suction control cam 408 turns to operate the valve 410 to apply vacuum to the suction cup 366 at predetermined intervals. At the same time, the sprocket 388 causes movement of the conveyor chains 352 thereby causing the puller bars 350 to move along in proper sequence. This chain movement causes the chain sprocket 386 to turn and drive the chain 384, thereby rotating the suction cup movement control cam 380 and the push down cam 406. This in turn produces swinging movements of the suction cup 366 and the push down element 394. The precise relationship of these movements is, of course, controlled by the cams 380 and 406.

As the beginning of a carton feed cycle, the various elements of the feed mechanism are in the positions shown in FIG. 28, with the push down element 394 in raised position and the suction cup 366 retracted. As the cycle proceeds to the stage illustrated in FIG. 29, the suction cup 366 engages the flap 364 of the carton blank 322 immediately adjacent the support plate 358. Vacuum is applied to the suction cup and it is retracted to pull the flap 364 back thereby partially bending it over the edge 360 of the support plate. This leaves an opening 412 between the partially pulled back flap 364 and the corresponding flap of the next adjacent carton blank.

Figures 29, 30, 31, 32:
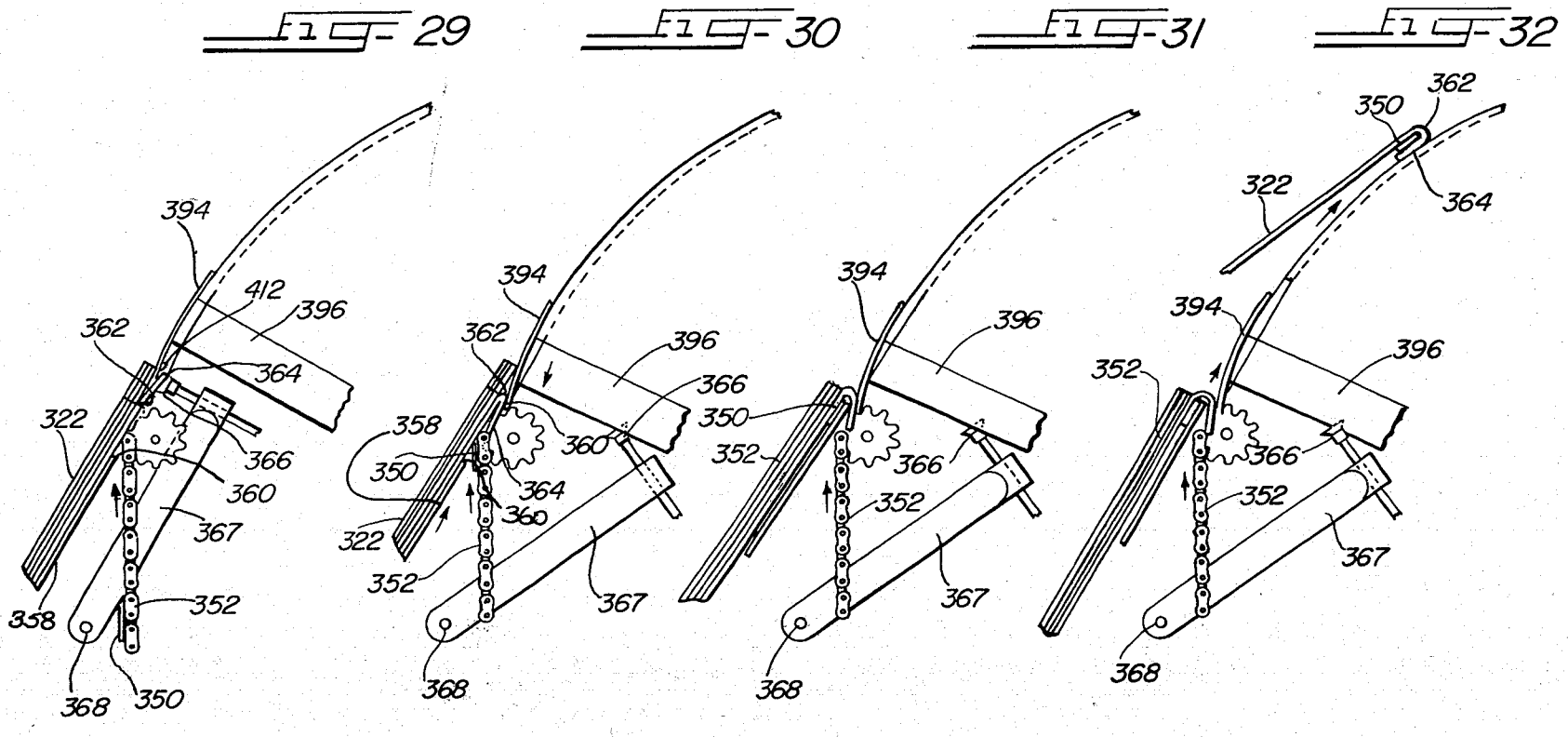

At this point in the cycle of operation the push down element 394 swings down and into the opening 412 to engage the flap 364. The push down element 394 continues to move down past the edge 360 of the support plate in the general direction of the plane of the support plate and on the opposite side thereof from the stack of carton blanks. This causes further bending of the flap 364 to a fully bent back position as shown in FIG. 30. During this further bending back of the flap, the suction cup 366 has its vacuum removed to release the flap. However, the suction cup continues to move back and away from the carton blank to allow clearance for completion of the flap bending.

After the flap 364 has been bent back as described, the continued movement of the conveyor chains 352 brings one of the puller bars 350 up along the support plate and into an inside corner formed between the carton blank and its bent back flap as shown in FIG. 31. Continued movement of the chains 352 causes the puller bar to engage the carton blank and pull it out from the stack. It will be seen in FIGS. 31 and 32 that during this last described movement the flap push down element 394 remains in its lowermost position and the chains 352 direct the puller bar 350 and the carton blank which it engages to pass up and over the outer surface of the push down element. Thereafter, the pushdown element and the suction cup are returned to their original position shown in FIG. 28 for the start of a new cycle.

Having thus described the invention with particular reference to the preferred forms thereof, it will be obvious to those skilled in the art to which the invention pertains, after understanding the invention, that various changes and modifications may be made therein without departing from the spirit and scope of the invention, as defined by the claims appended hereto.

We claim:

1. A method of forming flat sheets, which have been precut and prescored as carton blanks, into a carton configuration, said method comprising the steps of bending a flap on said blank downwardly and back against said blank to form an inside corner between the flap and the blank, engaging said inside corner along its entire length with a puller element and pulling said blank along, and while so pulling said blank, engaging various panels thereof with plow elements causing said blank to be bent upwardly around predetermined bend lines toward a tubular configuration.

2. A method according to claim 1 wherein several blanks are pulled along a given path one after the other to engage stationary plow elements in sequence.

3. A method according to claim 1 wherein a product to be packaged is deposited on said carton blank during said pulling and wherein said bending of said blank into tubular configuration causes it to encircle said product.

4. A method according to claim 1 wherein said flap is bent back upwardly to close said carton following formation of said blank into a tubular configuration.

5. A method according to claim 32 wherein said product is moved along the inside of an open top trough while the carton blank conveyed along the outside of said trough and is bent therearound.

6. A method according to claim 5 wherein said product is moved separately but in synchronism with said blank.

7. A method according to claim 6 wherein said product is removed from said trough and is deposited fully in said blank upon completion of said bending of said blank to encircle said product.

8. A method according to claim 7 wherein the separate movement of said product is terminated following depositing of said product in said carton whereby continued movement of said carton automatically maintains movement of said product.

9. A method according to claim 3 wherein said carton blank, after being formed about said product, is rotated sufficiently to bring longitudinally extended tabs thereon into a position lying crosswise of their path of movement and engaging said tabs with further plow members for causing bending of same to complete enclosure of said carton blank.

10. A carton forming machine in which flat sheets, which have been precut and prescored as carton blanks, are moved individually and in spaced apart relationship along a given path while being formed into a carton configuration, said machine comprising carton blank supply means for presenting said carton blanks, individually, with one flap of each blank bent back against the blank, a thin elongated puller bar, stationary blank bending means positioned at intermediate locations along said path, means for moving said puller bar continuously along said given path while maintaining said bar extended across said path to receive a carton blank presented thereto and to engage the carton blank along the entire length of an inside corner thereof formed between the bent back flap of said blank and an adjoining panel of said blank, said moving means being operative to move said puller bar, and a carton blank carried thereby, past said blank bending means so that outwardly extending panels of said blank engage said blank bending means and are forced by their movement past the blank bending means to bend about selected score lines thereon toward a tubular carton configuration, whereby said puller bar maintains the blank positively oriented while cooperating with said stationary blank bending means to form it into said carton configuration.

11. A carton forming machine according to claim 10 wherein said stationary blank bending means includes an elongated trough having an outer cross section corresponding to the cross section of a carton to be formed and having an inner cross section for accommodating movement therealong of a product to be packaged, and further includes plow elements located along the outside of said trough to engage portions of such carton blanks and to bend same against and around said trough to encircle said trough, means arranged along said trough beyond said plow elements to seal the edges of said carton blank to each other and product pusher means including pusher elements mounted to move products to be packaged along the inside of said trough in alignment with carton blanks moving along the outside of said trough.

12. A carton forming machine according to claim 10 wherein said carton blank supply means is constructed and arranged to supply said carton blanks with said one flap bent back downwardly of said blank and wherein said blank bending means is constructed and arranged to bend said panels upwardly.

13. A carton forming machine according to claim 12 further including means downstream of said blank bending means to bend said one flap back upwardly to close one end of said carton.

14. A carton forming machine according to claim 10 wherein said means for moving said puller bar comprises a pair of endless loops mounted parallel to each other and extending along said given path, said puller bar being connected to corresponding locations along said loops.

15. A carton forming machine according to claim 14 wherein several of said puller bars are positioned at mutually displaced locations along said loops.

16. A carton forming machine according to claim 10 wherein said blank bending means comprises stationary plow elements.

17. A carton forming machine according to claim 14 wherein said endless loops are interconnected to move at the same speed.

18. A carton forming machine according to claim 10 wherein said stationary blank bending means includes a trough having an outer cross section corresponding to the cross section of a finished carton and having an inner cross section accommodating a product, said puller bar being movable along the outside of said trough and a pusher bar movable inside said trough in synchronism with said puller bar.

19. A carton forming machine according to claim 18 wherein said stationary blank bending means further includes plow means situated along said trough, said trough terminating at a first location along said path downstream of said plow means.

20. A carton forming machine according to claim 19 wherein said pusher bar is arranged to move along said path to a second location downstream of said first location.

21. A carton forming machine according to claim 18 wherein said pusher bar is mounted on the end of an arm connected to an endless loop extending about rotatable elements displaced along said given path.

22. A carton forming machine according to claim 21 wherein said arm is pivotally connected to said loop at a first given location and wherein a connecting link is pivotally connected between a second location on said arm and a second location along said loop.

23. A carton forming machine according to claim 22 wherein said second location on said arm is on the side of said loop opposite from said pusher bar and wherein said second location along said loop is upstream of said first location.

24. A carton forming machine, according to claim 11 wherein said product pusher means is cantilevered out from the a support arm in the direction of its movement by said loop.

25. A carton forming machine, according to claim 24 wherein said machine includes a pair of mutually parallel endless loops between which said arm is mounted.

26. A carton forming machine according to claim 10, further including means forming a planar surface extending along said path parallel to and under said puller bar whereby a folded over carton flap can extend between said bar and said surface to be maintained in positive engagement with said puller bar.

* * * * *